US009183797B2

(12) United States Patent
Takahashi et al.

(10) Patent No.: US 9,183,797 B2
(45) Date of Patent: Nov. 10, 2015

(54) DISPLAY DEVICE AND CONTROL METHOD FOR DISPLAY DEVICE

(75) Inventors: Kohzoh Takahashi, Osaka (JP); Taketoshi Nakano, Osaka (JP); Asahi Yamato, Osaka (JP); Ken Inada, Osaka (JP); Fumiyuki Kobayashi, Osaka (JP); Toshihiro Yanagi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 128 days.

(21) Appl. No.: 14/110,767

(22) PCT Filed: Apr. 9, 2012

(86) PCT No.: PCT/JP2012/059739

§ 371 (c)(1),
(2), (4) Date: Oct. 9, 2013

(87) PCT Pub. No.: WO2012/141156

PCT Pub. Date: Oct. 18, 2012

(65) Prior Publication Data

US 2014/0028739 A1 Jan. 30, 2014

(30) Foreign Application Priority Data

Apr. 13, 2011 (JP) ..... 2011-089462

(51) Int. Cl.
*G09G 3/36* (2006.01)
*G09G 3/20* (2006.01)
(Continued)

(52) U.S. Cl.
CPC ..... *G09G 3/36* (2013.01); *G09G 3/2003* (2013.01); *G09G 3/3648* (2013.01);
(Continued)

(58) Field of Classification Search
CPC ..... G09G 2340/06; G09G 2300/0452; G09G 2360/16; G09G 3/3607
USPC ..... 345/88, 89, 102, 690
See application file for complete search history.

(56) References Cited

U.S. PATENT DOCUMENTS 5,929,843 A 7/1999 Tanioka
6,724,934 B1 4/2004 Lee et al.
(Continued)

FOREIGN PATENT DOCUMENTS

JP 05-241551 A 9/1993
JP 2001-119714 A 4/2001
(Continued)

OTHER PUBLICATIONS

Official Communication issued in International Patent Application No. PCT/JP2012/059739, mailed on Jun. 12, 2012.

*Primary Examiner* — Koosha Sharifi-Tafreshi
(74) *Attorney, Agent, or Firm* — Keating & Bennett, LLP

(57) ABSTRACT

Disclosed is a display device that (i) converts an input image formed of R, G, and B into a converted image formed of R, G, B, and W to display the converted image and that (ii) compresses the luminance of an input image for the subsequent frame on the basis of an adjustment value C which is corrected in correspondence with the number of, among all pixels in a converted image for the current frame, pixels in a state of luminance saturation and that then converts the input image into a converted image, the display device including a luminance oscillation detecting section (10) for detecting, while input images identical to each other are being inputted each as the above input image, whether converted images corresponding to the respective input images have an oscillating luminance, the display device, in the case where the luminance oscillation detecting section (10) has detected that the converted images have an oscillating luminance, stopping correction of the adjustment value C to fix the adjustment value C to a certain value, thereby preventing the converted images from having an oscillating luminance as a result of oscillation of the adjustment value C.

11 Claims, 8 Drawing Sheets

(51) Int. Cl.

| | |
|---|---|
| ***G09G 5/04*** | (2006.01) |
| ***G09G 5/06*** | (2006.01) |
| *G09G 3/34* | (2006.01) |

(52) U.S. Cl.

CPC .. *G09G 5/04* (2013.01); *G09G 5/06* (2013.01); *G09G 3/3406* (2013.01); *G09G 2300/0452* (2013.01); *G09G 2320/0242* (2013.01); *G09G 2320/0276* (2013.01); *G09G 2340/02* (2013.01); *G09G 2340/06* (2013.01); *G09G 2360/16* (2013.01)

(56) References Cited

U.S. PATENT DOCUMENTS

| | | | | |
|---|---|---|---|---|
| 7,859,499 | B2 * | 12/2010 | Furukawa | 345/88 |
| 2004/0046725 | A1 | 3/2004 | Lee | |
| 2009/0002298 | A1 | 1/2009 | Furukawa | |

FOREIGN PATENT DOCUMENTS

| | | | |
|---|---|---|---|
| JP | 2004-102292 | A | 4/2004 |
| WO | 20061080237 | A1 | 8/2006 |

* cited by examiner

FIG. 3

| | | | |
|---|---|---|---|
| R | W | R | W |
| G | B | G | B |
| R | W | R | W |
| G | B | G | B |

FIG. 4

| | | | | | | | |
|---|---|---|---|---|---|---|---|
| R | G | B | W | R | G | B | W |
| R | G | B | W | R | G | B | W |

DISPLAY DEVICE AND CONTROL METHOD FOR DISPLAY DEVICE

TECHNICAL FIELD

The present invention relates to a display device that (i) converts an input image including pixels having a first predetermined number of reference colors (for example, R, G, and B) into a converted image including pixels having a second predetermined number of reference colors (for example, R, G, B, and W), the second predetermined number being larger than the first predetermined number, and that (ii) displays the converted image.

BACKGROUND ART

A color liquid crystal display has conventionally included normally three pixels (picture elements) of R, G, and B in one (1) dot (pixel). Recent years have witnessed, however, a proposal of a color liquid crystal display that additionally includes a white (W) picture element for improved luminance, the color liquid crystal display thus including a total of four picture elements of R, G, B, and W in one (1) dot. This RGBW color liquid crystal display is advantageous in terms of luminance improvement, but tends to have chroma decrease. An RGBW color liquid crystal display thus requires careful selection of a method for determining, for example, the structure and output gray-scale level of a W picture element.

Patent Literature 1, for example, discloses information on the structure of a W picture element. Specifically, it proposes reducing the size of a W picture element so that it is smaller than the size of any of R, G, and B picture elements. This intends to prevent chroma decrease resulting from a display signal for a W picture element.

Patent Literature 1 further discusses converting input RGB data into RGBW data and then converting the RGBW data into optimized data R'G'B'W'. After so converting RGB data into RGBW data (by a method of which no detailed description is provided), the technique of Patent Literature 1 further converts the resulting RGBW data as above in order to both improve luminance and maintain chroma.

A W picture element being smaller in size than R, G, and B picture elements, however, leads to the luminance improvement effect being lessened accordingly. Patent Literature 1 discloses in an Example a calculation result of a 50% luminance increase. This calculation result is, however, for the case in which R, G, B, and W picture elements all have an equal size. The technique of Patent Literature 1 merely produces a luminance increase of approximately 42% in the case where, for instance, R=G=B=1.05 and W=0.85 with the index of 1 being for the original size of a picture element of each color. This indicates that the technique of Patent Literature 1 can maintain chroma, but cannot improve luminance sufficiently.

In addition, converting R, G, and B input signals into R, G, B, and W signals and then further converting the R, G, B, and W signals into signals of R', G', B', and W' forces a driving circuit to internally carry out arithmetic processing in an even larger amount, resulting in (i) the circuit being overly large and (ii) a cost increase.

Patent Literature 2 discloses a most convenient technique (method) for calculating R, G, B, and W signals from R, G, and B signals. This technique is characterized to involve (i) means (min detecting section 1) for extracting a white-color signal from a plurality of color component signals inputted and (ii) means for outputting, on the basis of the extracted white-color signal and the plurality of color component signals, display signals for four respective colors including at least white. This technique is also characterized to involve means for nonlinearly processing the extracted white-color signal and outputting display signals on the basis of the plurality of color component signals and the nonlinearly converted white-color signal.

The above method extracts a minimum value among the respective values of R, G, and B signals as a white signal W, and nonlinearly converts W into W' as necessary. The above method thus carries out the following calculation:

$$\mathrm{OUT}(R,G,B)=\mathrm{IN}(R,G,B)-\mathrm{OUT}(W),\text{ and}$$

$$\mathrm{OUT}(W)=W\text{ or }W'$$

The above method inevitably causes at least one of R, G, and B outputs to be 0 if W is not nonlinearly processed. During a white or gray display in particular, Rout=Gout=Bout=0 and W=min(Rin, Gin, Bin), which leads to no luminance improvement and to significant chroma decrease. Nonlinearly processing W into W' may alleviate the problem of chroma decrease, but still fails to improve luminance because carrying out nonlinear processing does not mean carrying out luminance expansion with respect to input signals.

Patent Literature 3, for example, discloses a more complex technique for calculating R, G, B, and W signals from R, G, and B signals. Patent Literature 3 proposes a method for determining a white-color signal component, the method including (i) a step of determining the amount of luminance increase separately for each of the reference color components included in predetermined color signals, (ii) a step of extracting data on the amount of luminance increase for a white-color signal component from the respective amounts of luminance increase for the reference color components, and (iii) a step of setting the amount of luminance increase for a white-color signal component as a white-color signal component for the predetermined color signals.

The description below deals in detail with the technique of Patent Literature 3 with reference to FIG. 9. FIG. 9 illustrates only a case of a system involving two signals of R and G for simplification. In the case where, for instance, R is a minimum luminance signal Lmin and G is a maximum luminance signal Lmax, the technique of Patent Literature 3 carries out luminance expansion for (i) color A to produce a maximum luminance A' on a O-A extension and also for (ii) color C, which has an R-G luminance ratio equal to that of color A, at S=OA'/OA. This technique employs the expansion rate of S=OB'/OB for color D similarly. Thus, the luminance expansion rate S and t (=Lmin/Lmax) have a relation illustrated in FIG. 10.

The conventional technique disclosed in Patent Literature 3, however, problematically decreases the quality of a display image. Specifically, the above conventional technique poses the following problems: First, the conventional technique carries out no luminance expansion with respect to primary colors. Thus, in the case where a primary color and white are adjacent to each other, the primary color is seen as having chroma decrease, thereby decreasing the quality of a display image. Second, the conventional technique involves a luminance expansion rate S that is, as illustrated in FIG. 10, saturated at t=0.5 and that has a curve which is bent abruptly. This leads to the presence of a pattern at which a video image is seen unnaturally, thereby decreasing the quality of a display image.

As described above, the respective techniques of Patent Literatures 1 to 3 are each problematic in that it cannot improve luminance while maintaining the hues of a video image and decreases the quality of a display image when determining color signals of R, G, B, and W from color signals of R, G, and B.

Patent Literature 4 discloses a technique that solves the above problem. This technique of Patent Literature 4 determines color signals of R, G, B, and W from color signals of R, G, and B as follows: The technique carries out luminance compression with respect to color signals of R, G, and B for the current frame at a predetermined luminance compression ratio selected in correspondence with the respective luminances of color signals of R, G, B, and W for the last frame to determine post-compression color signals of R, G, and B. The technique next determines a luminance expansion rate on the basis of the ratio between the value of a minimum luminance and that of a maximum luminance of the post-compression color signals, and carries out luminance expansion with respect to the post-compression color signals at the luminance expansion rate to determine luminance-expanded color signals of R, G, and B. The technique then multiplies the minimum luminance value by a coefficient k to determine a corrected minimum luminance value, and subtracts the corrected minimum luminance value from each of the luminance-expanded color signals to determine luminance-expanded converted color signals of R, G, and B. The technique also sets a white-color (W) signal to have the minimum luminance value. The technique thus uses the luminance-expanded converted color signals of R, G, and B and the white-color signal as color signals of R, G, B, and W.

Patent Literature 4 solves the above problem by determining color signals of R, G, B, and W from color signals of R, G, and B as described above.

The technique of Patent Literature 4 controls the predetermined luminance compression ratio through feedback processing to an optimum value in order to prevent a predetermined number or more of luminance-saturated dots from being present in an image represented by color signals of R, G, B, and W (hereinafter referred to as "converted image").

In other words, the technique of Patent Literature 4, (i) in the case where there are present a predetermined number or more of luminance-saturated dots in a converted image for the current frame, decreases the value of the predetermined luminance compression ratio for use in determining a converted image for the subsequent frame, and (ii) otherwise increases the value of the predetermined luminance compression ratio for use in determining a converted image for the subsequent frame.

CITATION LIST

Patent Literature 1

Japanese Patent Application Publication, Tokukai, No. 2004-102292 A (Publication Date: Apr. 2, 2004)

Patent Literature 2

Japanese Patent Application Publication, Tokukaihei, No. 5-241551 A (Publication Date: Sep. 21, 1993)

Patent Literature 3

Japanese Patent Application Publication, Tokukai, No. 2001-119714 A (Publication Date: Apr. 27, 2001)

Patent Literature 4

WO2006/080237 (Publication Date: Jan. 19, 2006)

SUMMARY OF INVENTION

Technical Problem

The technique of Patent Literature 4, which controls the predetermined luminance compression ratio through feedback processing to an optimum value as described above, may unfortunately cause the value of the predetermined luminance compression ratio to oscillate over frames as a result of the feedback processing.

Specifically, the following example case may result: Increasing the value of the predetermined luminance compression ratio for use in determining a converted image for a frame decreases the value of the predetermined luminance compression ratio for use in determining a converted image for the subsequent frame, which then increases the value of the predetermined luminance compression ratio for use in determining a converted image for the frame immediately after the subsequent frame.

The technique of Patent Literature 4 is problematic in that such an operation causes a display image to have an oscillating luminance and flicker and thus decreases the display quality.

The present invention has been accomplished in view of the above problem. It is an object of the present invention to provide (I) a display device that (i) converts an input image including pixels having a first predetermined number of reference colors into a converted image including pixels having a second predetermined number of reference colors, the second predetermined number being larger than the first predetermined number, and that (ii) displays the converted image, the display device being capable of preventing the display quality from decreasing as a result of oscillation of the luminance of a display image, and (II) a method for controlling a display device.

Solution to Problem

In order to solve the above problem, a display device of the present invention is a display device that converts (i) an input image including pixels having a first predetermined number of reference colors into (ii) a converted image including pixels having a second predetermined number of reference colors, the second predetermined number being larger than the first predetermined number, and that displays the converted image, the display device including: converting means for converting a luminance of the input image into a luminance of the converted image on a basis of a set value during the conversion of the input image into the converted image; luminance oscillation detecting means for detecting, while the converting means is sequentially receiving input images that are substantially identical to each other, whether converted images corresponding to the respective input images have an oscillating luminance; and luminance fixing means for fixing the luminance of the converted image in a case where the luminance oscillation detecting means has detected that the converted images have an oscillating luminance.

A method of the present invention for controlling a display device is a method for controlling a display device that (i) converts an input image including pixels having a first predetermined number of reference colors into a converted image including pixels having a second predetermined number of reference colors, the second predetermined number being larger than the first predetermined number, and that (ii) displays the converted image, the method including the steps of: (a) converting a luminance of the input image into a luminance of the converted image on a basis of a set value during the conversion of the input image into the converted image; (b) detecting, while the converting means is sequentially receiving input images that are substantially identical to each other, whether converted images corresponding to the respective input images have an oscillating luminance; and (c) fixing the luminance of the converted image in a case where the step (b) has detected that the converted images have an oscillating luminance.

The above arrangement includes (i) luminance oscillation detecting means for detecting, while input images that are substantially identical to each other are being inputted sequentially, whether converted images corresponding to the respective input images have an oscillating luminance and (ii) luminance fixing means for fixing the luminance of the converted image in a case where the luminance oscillation detecting means has detected that the converted images have an oscillating luminance. The above arrangement thus makes it possible to (i) detect oscillation of the luminance of converted images and (ii) fix the luminance of the converted image in the case where the luminance oscillation detecting means has detected that the converted images have an oscillating luminance. The above arrangement consequently makes it possible to (i) prevent the screen luminance from flickering as a result of oscillation of the luminance of converted images and consequently (ii) prevent the display quality from decreasing as a result of oscillation of the luminance of a display image.

Advantageous Effects of Invention

As described above, a display device of the present invention is a display device that converts (i) an input image including pixels having a first predetermined number of reference colors into (ii) a converted image including pixels having a second predetermined number of reference colors, the second predetermined number being larger than the first predetermined number, and that displays the converted image, the display device including: converting means for converting a luminance of the input image into a luminance of the converted image on a basis of a set value during the conversion of the input image into the converted image; luminance oscillation detecting means for detecting, while the converting means is sequentially receiving input images that are substantially identical to each other, whether converted images corresponding to the respective input images have an oscillating luminance; and luminance fixing means for fixing the luminance of the converted image in a case where the luminance oscillation detecting means has detected that the converted images have an oscillating luminance.

A method of the present invention for controlling a display device is a method for controlling a display device that (i) converts an input image including pixels having a first predetermined number of reference colors into a converted image including pixels having a second predetermined number of reference colors, the second predetermined number being larger than the first predetermined number, and that (ii) displays the converted image, the method including the steps of: (a) converting a luminance of the input image into a luminance of the converted image on a basis of a set value during the conversion of the input image into the converted image; (b) detecting, while the converting means is sequentially receiving input images that are substantially identical to each other, whether converted images corresponding to the respective input images have an oscillating luminance; and (c) fixing the luminance of the converted image in a case where the step (b) has detected that the converted images have an oscillating luminance.

The above arrangements each make it possible to advantageously prevent the display quality from decreasing as a result of oscillation of the luminance of a display image.

BRIEF DESCRIPTION OF DRAWINGS

FIG. 3 is a plan view of an array of individual picture elements of the liquid crystal display device of Embodiment 1 of the present invention.

FIG. 4 is a plan view of another array of individual picture elements of the liquid crystal display device of Embodiment 1 of the present invention.

DESCRIPTION OF EMBODIMENTS

Embodiment 1

The description below deals with one embodiment of a liquid crystal display device as a display device of the present invention with reference to FIGS. 1 through 6.

(Arrangement Description)

The liquid crystal display device of the present embodiment is arranged as a liquid crystal display device capable of carrying out high-resolution display, for example, an active matrix liquid crystal display device including thin film transistors (hereinafter referred to as "TFTs") as switching elements.

The liquid crystal display device of the present embodiment is further arranged as a liquid crystal display device that converts (i) an input image including pixels having a first predetermined number of reference colors (in the present embodiment, the three colors of R [red], G [green], and B [blue]) into (ii) a converted image including pixels having a second predetermined number of reference colors (in the present embodiment, the four colors of R [red], G [green], B [blue], and W [white]), the second predetermined number being larger than the first predetermined number, and that displays the converted image.

Figure 2:
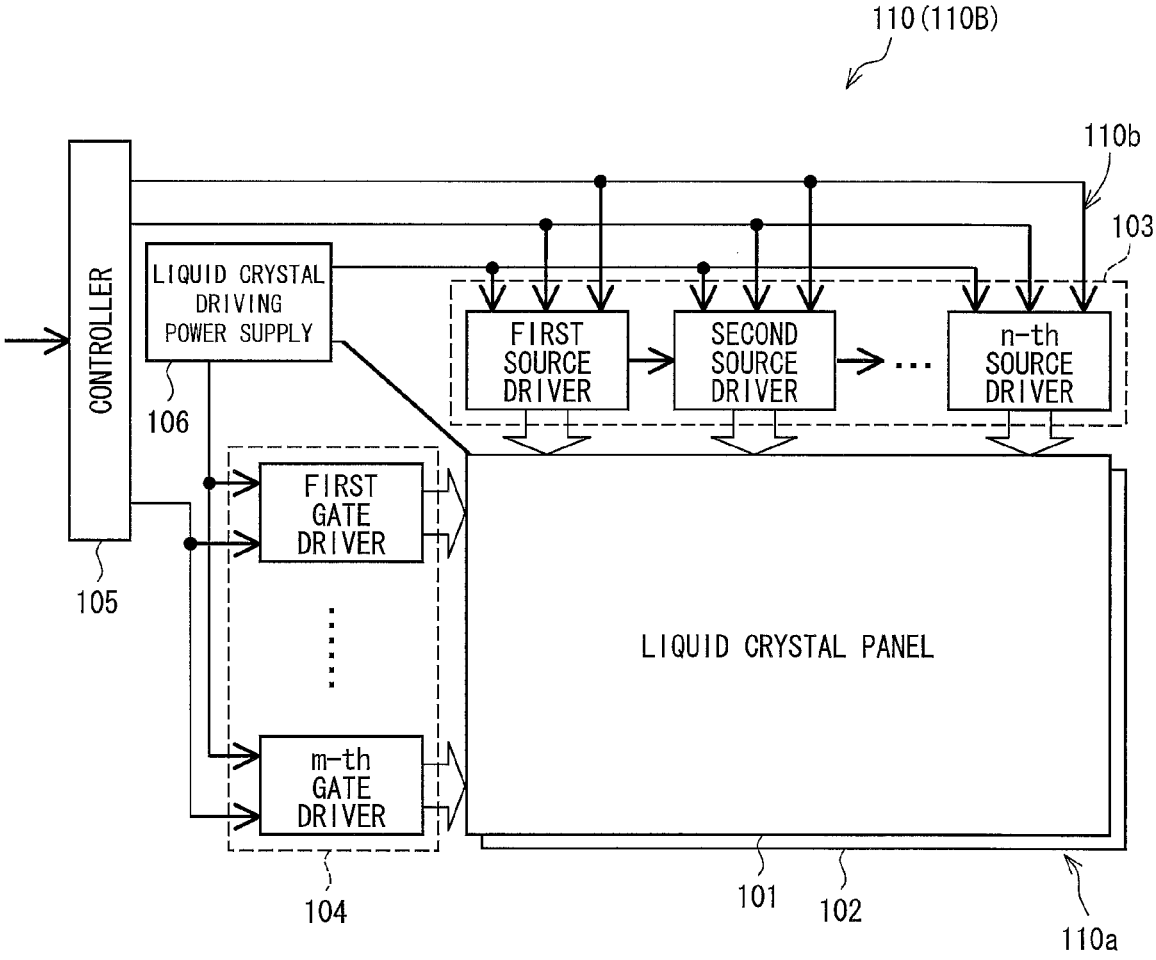
FIG. 2 is a diagram schematically illustrating a configuration of the liquid crystal display device of Embodiment 1 of the present invention.

The liquid crystal display device 110 of the present embodiment, as illustrated in FIG. 2, includes a liquid crystal panel (non-self-light-emitting display section) 110*a* and a liquid crystal driving control circuit 110*b* for drivingly controlling the liquid crystal panel 110*a*. The liquid crystal panel 110*a* includes a TFT liquid crystal panel 101 (non-self-light-emitting display section) and a backlight (illumination means) 102 for illuminating the liquid crystal panel 101.

The liquid crystal panel 101 includes a plurality of pixels arrayed in a matrix (for example, 1024×768 pixels [XGA]), and displays a video image by carrying out display on the basis of video signals of R, G, B, and W for each horizontal scanning line successively or in the vertical direction intermittently or successively.

An XGA liquid crystal panel has a total of 768 horizontal scanning lines, each horizontal scanning line including 1024 pixels. The number of pixels can also be, for example, 1280×1024 pixels (SXGA), 1600×1200 pixels (UXGA), or 3200×2400 pixels (2.7 p/J) as necessary. The liquid crystal display device 110 may alternatively have a wide screen having an aspect ratio other than 4:3 (for example, full HD: 1920×1080, or WXGA: 1366×768).

The plurality of pixels, as illustrated in FIG. 3, each include picture elements having four colors, namely a R (red) picture element, a G (green) picture element, a B (blue) picture element, and a W (white) picture element arrayed in a matrix of 2×2.

The picture elements of the four colors each include a liquid crystal display element that has a TFT (not shown) and that transmits or blocks light (backlighting) as controlled by the TFT. This liquid crystal display element has a well-known arrangement, and is thus not described here in detailed.

The R picture element, the G picture element, and the B picture element each include (i) a light-transmitting glass substrate and (ii) a color filter (not shown) having a corresponding color and attached to the glass substrate, whereas the W picture element includes only a light-transmitting glass substrate and no filter. The picture elements of the four colors can be arrayed in a four-color stripe arrangement as illustrated in FIG. 4, in a mosaic arrangement (not shown), or in a delta arrangement (not shown).

The backlight 102 is arranged as, for example, a white-light source, and is provided behind the liquid crystal panel 101 to illuminate the liquid crystal panel 101.

The liquid crystal driving control circuit 110*b* includes (i) a source driver 103 and a gate driver 104 (display control means), each including an IC (integrated circuit), (ii) a controller 105, and (iii) a liquid crystal driving power supply 106.

The controller 105 controls the backlight 102 to, for example, adjust the luminance of the backlight 102 for each frame or for each plurality (5 or 6) of frames to a maximum luminance among the luminances indicated by respective video signals for the frame or for the plurality of frames.

The controller 105 extracts color signals of R, G, and B and sync signals (for example, a horizontal sync signal and a vertical sync signal) from video signals for the three colors of R, G, and B, the video signals having been inputted from outside. The controller 105 also converts the extracted color signals of R, G, and B into color signals of R, G, B, and W. In other words, the controller 105 converts (i) an input image including pixels having R, G, and B into (ii) a converted image including pixels having R, G, B, and W. The color signals of R, G, and B are each a piece of gray-scale data.

The controller 105 drivingly controls the gate driver 104 on the basis of a sync signal, and also drivingly controls the source driver 103 on the basis of the color signals of R, G, B, and W and a sync signal.

The gate driver 104 successively selects pixels for, for example, each horizontal scanning line (each row) on the basis of the vertical sync signal from the controller 105, and applies a gate voltage (control signal) to the gate of the TFT of each picture element included in each of the pixels successively selected.

The gate driver 104 of the present embodiment includes first through m-th gate drivers (where m is the number of rows formed by the plurality of pixels in a matrix). The first through m-th gate drivers each correspond to a row of pixels among the plurality of pixels. The first through m-th gate drivers operate in the order of, for example, the first gate driver to the m-th driver on the basis of a sync signal from the controller 105, and thus each select corresponding pixels to apply a gate voltage (control signal) to the gate of the TFT of each picture element included in each of the pixels.

The source driver 103, on the basis of a sync signal from the controller 105 (that is, in synchronization with the pixel selection by the gate driver 104), applies, to the respective sources of the TFTs of the picture elements of R, G, B, and W included in each of the pixels selected by the gate driver 104, source voltages having respective values corresponding to the color signals of R, G, B, and W from the controller 105.

The source driver 103 of the present embodiment includes first through n-th source drivers (where n is the number of columns formed by the plurality of pixels in a matrix). The first through n-th source drivers each correspond to a column of pixels among the plurality of pixels. The first through n-th source drivers, while the gate driver 104 is selecting a row of pixels, operate in the order of, for example, the first source driver to the n-th source driver on the basis of a sync signal from the controller 105, and thus each select corresponding pixels to apply, to the respective sources of the TFTs of the picture elements included in each of the pixels, source voltages having respective values corresponding to the color signals of R, G, B, and W from the controller 105.

With the above arrangement, when a picture element is selected simultaneously by the gate driver 104 and the source driver 103, the transmittance (that is, the gray-scale level) of that picture element is controlled by its TFT in correspondence with the value of a source voltage applied to that TFT. As described above, the pixels, each including picture elements having respective controlled gray-scale levels, each emit, when illuminated by backlighting, light having a color corresponding to the combination of the respective gray-scale levels of the picture elements included in the pixel.

Figure 1:
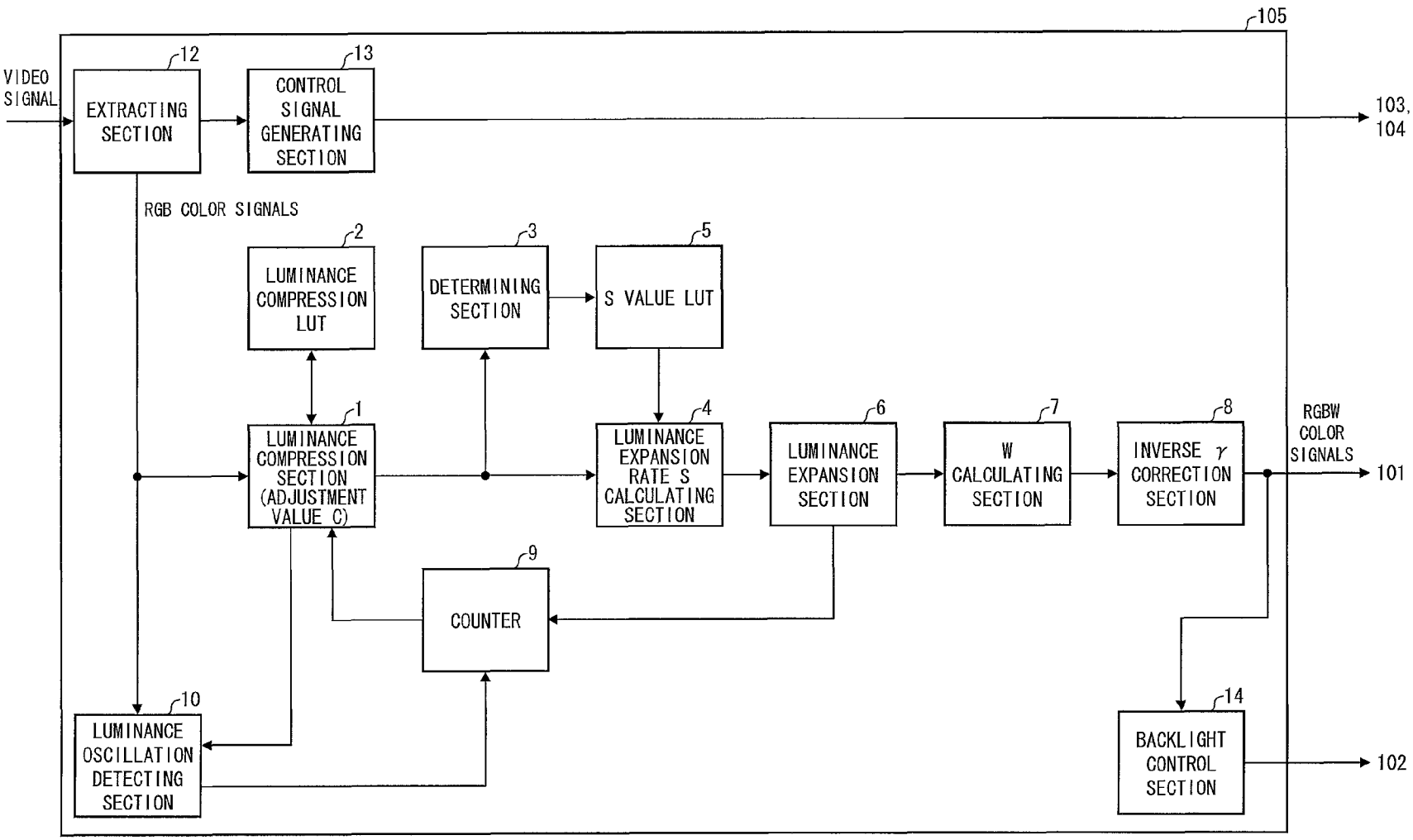
FIG. 1 is a diagram schematically illustrating a controller included in a liquid crystal display device of Embodiment 1 of the present invention.

The controller 105, as illustrated in FIG. 1, includes a luminance compression section 1 (luminance compression means), a luminance compression lookup table (hereinafter referred to as "luminance compression LUT") 2, a determining section 3, a luminance expansion rate S calculating section 4, an S value lookup table (hereinafter referred to as "S value LUT") 5, a luminance expansion section 6 (luminance expansion means), a W calculating section 7 (additional color calculating means), an inverse γ correction section 8, a counter 9 (luminance control means, luminance fixing means), a luminance oscillation detecting section 10 (luminance oscillation detecting means), an extracting section 12, a control signal generating section 13, and a backlight control section 14 for controlling the luminance of backlighting.

The present embodiment provides converting means made up of the luminance compression section 1, the luminance compression LUT 2, the determining section 3, the luminance expansion rate S calculating section 4, the S value LUT 5, the luminance expansion section 6, and the W calculating section 7.

The luminance compression LUT 2 and the S value LUT 5 store data for use by the luminance compression section 1 and the luminance expansion rate S calculating section 4 respectively, and may each be any memory that meets the specifications of the corresponding one of the luminance compression section 1 and the luminance expansion rate S calculating section 4. The luminance compression LUT 2 and the S value LUT 5 are each a dual-port random access memory, for example.

The extracting section 12 extracts (i) color signals of R, G, and B (that is, an image [input image] including pixels of R, G, and B) and (ii) sync signals (for example, a horizontal sync signal and a vertical sync signal) from video signals inputted from outside (in the present embodiment, video signals for a video image including pixels of the three colors of R, G, and B).

The luminance compression section 1 compresses, at a preset luminance compression ratio K, luminances indicated, for the above pixels, by the respective color signals of R, G, and B extracted by the extracting section 12, and outputs post-compression color signals indicative of the respective compressed luminances.

In the present embodiment, the color signals of R, G, and B each indicate a gray-scale level as described above. The gray-scale has, for example, $2^8$ levels, that is, 256 levels (level 0 to level 255), and may alternatively be $2^{10}$ levels, that is, 1024 levels.

The luminance compression ratio K is set to an adjustment value C (set value) multiplied by a constant value (in the present embodiment, K=C/1.35). The adjustment value C is, (i) for the first input image, an initial set value, and (ii) for any subsequent input image, a corrected adjustment value C obtained by correcting, through feedback processing as described later, an adjustment value C having been used for an input image that is a frame previous to the subsequent input image.

In the present embodiment, the luminance compression LUT 2 stores in advance (i) various values for the adjustment value C and (ii) post-compression color signals corresponding respectively to various values for color signals of R, G, and B. The luminance compression section 1 reads out, from the luminance compression LUT 2, (i) an adjustment value C and (ii) post-compression color signals of R, G, and B corresponding respectively to respective values of the extracted color signals of R, G, and B, and outputs the post-compression color signals.

The above luminance compression is expressed by, for example, L'(R, G, B)=Lin(R, G, B)*C/1.35, where (i) the symbol "*" denotes multiplication, (ii) Lin(R, G, B) denotes gray-scale data on each color signal before luminance compression, and (iii) L'(R, G, B) denotes gray-scale data on each post-compression color signal after luminance compression. The adjustment value C of the present embodiment is set to change not continuously but stepwise by 0.05, for example. This indicates that the luminance compression includes eight steps. The luminance compression may alternatively include four steps or 16 steps as necessary.

The above luminance compression involves bit extension (for example, from $2^8$ levels to $2^9$ levels) to prevent gray-scale data from being lost through the luminance compression. The luminance compression section 1 thus outputs, after the luminance compression, gray-scale data that has been subjected to bit extension.

The determining section 3 detects, from post-compression color signals L'(R, G, B) of R, G, and B for the pixels which post-compression color signals L'(R, G, B) have been supplied from the luminance compression section 1, (i) minL'(R, G, B), which represents a minimum luminance value for the pixels, and (ii) maxL'(R, G, B), which represents a maximum luminance value for the pixels. The determining section 3 then determines the ratio t ($0 \le t \le 1$) between minL'(R, G, B) and maxL'(R, G, B), that is, t=minL'(R, G, B)/maxL'(R, G, B), and outputs data on the ratio t.

The present embodiment covers the case of minL'(R, G, B)=maxL'(R, G, B) as well. The determining section 3 may alternatively calculate the ratio t. Further, such calculation may be carried out by the luminance expansion rate S calculating section 4 or luminance expansion section 6 described later, in which case the determining section 3 can be omitted.

The luminance expansion rate S calculating section 4 finds a luminance expansion rate S with reference to the ratio t determined by the determining section 3, and outputs data on the luminance expansion rate S thus found.

In the present embodiment, the S value LUT 5 stores in advance various values for the luminance expansion rate S, the values corresponding respectively to various values for the ratio t. The luminance expansion rate S calculating section 4 reads out, from the S value LUT 5, a luminance expansion rate S corresponding to the value of the ratio t determined by the determining section 3, and outputs data on the luminance expansion rate S thus read out.

The luminance expansion rate S is expressed as a function F(t) of the ratio t. The luminance expansion rate S of the present embodiment is, as an example, expressed as a quadratic function such as $S=F(t)=a*t^2+b*t+Cmax$, where Cmax is set to 1.35, for example.

$C_{max}$ is set to 1.35 on the basis of the following result of actual evaluation: The luminance expansion rate S is expressed as $S=C_{max}=1.35$ by the above quadratic function in the case where t=0, that is, where each pixel is produced from (i) a single one of R, G, and B or from (ii) a color mixture (cyan, magenta, or yellow) of two of R, G, and B. However, in the case where S exceeds 1.35 and the luminance ratio is increased between the single color or color mixture and white, the single color or color mixture becomes darkened and somber.

In other words, converting a three-color RGB configuration into a four-color RGBW configuration multiplies the maximum luminance of each of the picture elements of R, G, and B by 0.75. Thus, causing each of the picture elements of R, G, and B to produce its original brightness simply requires setting each of the respective luminances of the picture elements of R, G, and B to a value obtained by multiplying the luminance value by 1.33. C corresponds to the luminance expansion rate S, so that $C_{max}$ should, if on the basis of the above principle, simply be 1.33. $C_{max}$ is, however, set to 1.35 because C is changed preferably by 0.05 for convenience of control.

The function F(t) can be changed variously as necessary. The present embodiment sets the function F(t) so that $F(t+\Delta t)>\{F(t)+F(t+2\Delta t)\}/2$. In other words, the function F(t) simply needs to be a function which is convex upward and of which the value (i) is positive if $0 \le t \le 1$, (ii) monotonously increases with an increase of t, and (iii) has an increase rate that decreases with an increase of t.

The function F(t) of the present embodiment is, for example, desirably set on the basis of Tc and Tw, where (i) Tc is the average transmittance (luminous efficiency) of the color filters (CFs) of the respective colors (R, G, and B) for use in the liquid crystal panel 101, and (ii) Tw is the transmittance (luminous efficiency) for white (W).

Specifically, in the case where $F(t)=a*t^2+b*t+1.35$, the present embodiment preferably selects respective values for the symbols "a" and "b" in correspondence with the CFs so that F(0)=1.35, F(1)=m, and F(0.5)=0.9 m with reference to the maximum luminance expansion rate m (where m=(3Tc+Tw)/3Tc). In this preferable case, a=2.7−1.6 m, and b=2.6 m−4.05.

The luminance expansion section 6 calculates, with reference to the luminance expansion rate S supplied from the luminance expansion rate S calculating section 4, luminance-expanded converted signals Lout(R, G, B) of R, G, and B indicative of respective luminances as expanded from those indicated by the respective post-compression color signals L'(R, G, B) of R, G, and B. The luminance expansion section 6 then outputs the luminance-expanded converted signals Lout(R, G, B) thus calculated.

Specifically, the luminance expansion section 6 calculates luminance-expanded converted signals Lout(R, G, B) of R, G, and B by, for example, the arithmetic expression Lout(R, G, B)=L'(R, G, B)*S−min(L'(R, G, B))*k.

L'(R, G, B)*S represents luminance-expanded color signals of the respective three colors. k is a constant unique to a liquid crystal panel 101 in use, and indicates the ratio of transmittance of each of the colors (R, G, and B) to white over the liquid crystal panel 101. k is expressed as k=Tw/3Tc, where Tc and Tw are as described above.

The W calculating section 7 calculates a W color signal Lout(W) (additional color) from the post-compression color signals L'(R, G, B). The W calculating section 7 of the present embodiment outputs data on the above minL'(R, G, B) as a W color signal Lout(W). The present embodiment, in other words, sets Lout(W) as Lout(W)=minL'(R, G, B).

Thus, the present embodiment, which includes the luminance compression section 1, the luminance expansion section 6, and the W calculating section 7 each described above, can set the luminance of the W color signal so that (i) the luminance is equal to the minimum luminance indicated by the luminance-expanded converted color signals of R, G, and B (if t=1) or that (ii) the luminance is lower than the minimum luminance (if 0≤t<1). Further, setting k=Tw/3Tc can set the coefficient k so that the coefficient k, if the ratio t is 1, offsets an increase caused at the luminance expansion rate S by luminance expansion for the luminance-expanded color signals.

The present embodiment produces color signals of R, G, B, and W from (i) the luminance-expanded converted signals of R, G, and B calculated by the luminance expansion section 6 and (ii) the W color signal calculated by the W calculating section 7. The color signals of R, G, B, and W form a converted image mentioned above.

The inverse γ correction section 8 carries out inverse γ correction with respect to the color signals of R, G, B, and W calculated as above (that is, converts gray scale into luminance), and outputs the resulting color signals of R, G, B, and W in correspondence with a γ characteristic of the liquid crystal panel 101. This operation converts each of the color signals of R, G, B, and W into a signal indicative of a luminance, and outputs such converted signals.

Figure 5:
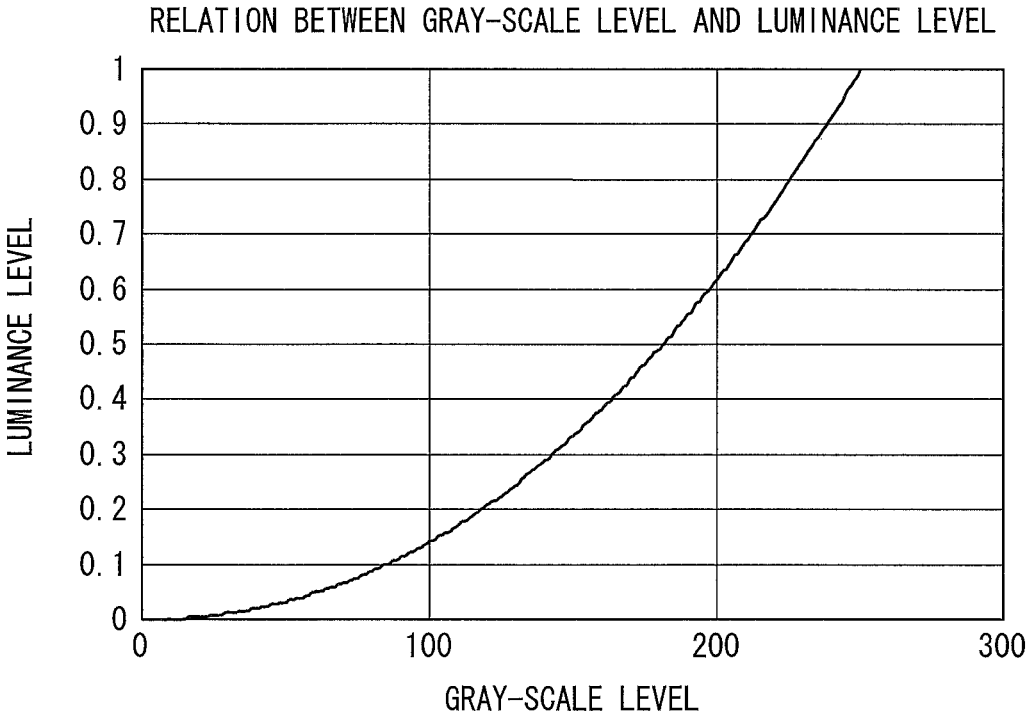
FIG. 5 is a graph illustrating a relation between the gray-scale level and luminance level of each color signal for the liquid crystal display device of Embodiment 1 of the present invention.

The present embodiment sets the value of γ to γ=2.4 to 2.6 to display a sharper video image. The inverse γ correction section 8 defines the relation between gray-scale levels and luminance levels as illustrated in FIG. 5, for example.

The counter 9 detects whether a converted image is in a state of luminance saturation, and corrects the adjustment value C for use by the luminance compression section 1 in correspondence with the result of the detection. Specifically, the counter 9 (i) reduces the adjustment value C in the case where the converted image includes larger than a first threshold number of pixels in the state of luminance saturation, and (ii) increases the adjustment value C in the case where the converted image includes not larger than a second threshold number of pixels in the state of luminance saturation, the second threshold number being not larger than the first threshold number.

More specifically, the counter 9 of the present embodiment counts, for each of the colors of R, G, and B separately, picture elements (that is, picture elements in the state of luminance saturation) each having a gray scale level higher than 255, which is the highest gray scale level, in a converted image of the current frame. The counter 9 then sets a count-over flag ROV•GOV•BOV for, if any, a color among the colors of R, G, and B for which color the above count is greater than the first threshold number (for example, 2% of all the pixels). The counter 9 further sets a count-0 flag R00•G00•B00 for, if any, a color among the colors of R, G, and B for which color the above count is not greater than the second threshold number (in the present embodiment, zero).

The first threshold number has a lower limit value of 1%, preferably 1.2%, or more preferably 1.5% of all the pixels for a single frame. The first threshold number has an upper limit value of 10%, desirably 6%, or more desirably 4% of all the pixels for a single frame.

The counter 9, in the case where it has set one of count-over flags ROV, GOV, and BOV for a corresponding one of the colors of R, G, and B, reduces the adjustment value C (that is, an adjustment value C for use in luminance compression of an input image for the subsequent frame) set for the luminance compression section 1 (that is, the counter 9 corrects the adjustment value C as C→C−0.05).

The counter 9, in the case where it has set count-0 flags R00•G00•B00 for all the colors of R, G, and B, increases the adjustment value C set for the luminance compression section 1 (that is, the counter 9 corrects the adjustment value C as C→C+0.05). The counter 9 otherwise does not correct the adjustment value C set for the luminance compression section 1.

The counter 9, upon receipt of an adjustment value fixing control signal described later from the luminance oscillation detecting section 10, stops the above correction of the adjustment value C, and then fixes the adjustment value C to a certain value (for example, to an adjustment value C achieved at the time of receipt of the adjustment value fixing control signal). The counter 9 then restarts the above correction of the adjustment value C a predetermined time period after the receipt of the adjustment value fixing control signal, for example.

The luminance oscillation detecting section 10 detects, while the luminance compression section 1 or extracting section 12, for example, is receiving input images identical to each other, whether the luminance of the corresponding converted images is oscillating.

The present embodiment carries out luminance compression with respect to the color signals of R, G, and B at a luminance compression ratio K corresponding to an adjustment value C, and then carries out luminance expansion with respect to the resulting color signals of R, G, and B at a luminance expansion rate S. The color signals indicative of respective luminances as expanded thus each indicate a luminance value that depends on the adjustment value C. Specifically, a larger adjustment value C results in a higher luminance for each color signal after luminance expansion, whereas a smaller adjustment value C results in a lower luminance for each color signal after luminance expansion.

The luminance oscillation detecting section 10 of the present embodiment, in view of the above, detects, (i) on the basis of the adjustment value C and (ii) while input images identical to each other are being inputted, whether the luminance of the corresponding converted images is oscillating.

Specifically, the luminance oscillation detecting section 10 stores adjustment values C used for luminance compression of input images in correspondence with, for example, three consecutive frames (namely, the three frames of the current frame, the last frame, and the frame before last), and detects a change of the adjustment value C over the three frames.

In the case where (i) the above change is increase→decrease (that is, the adjustment value C for the second frame is larger than the adjustment value C for the first frame, and the adjustment value C for the third frame is smaller than the adjustment value C for the second frame) or in the case where (ii) the above change is decrease→increase (that is, the adjustment value C for the second frame is smaller than the adjustment value C for the first frame, and the adjustment value C for the third frame is larger than the adjustment value C for the second frame), the luminance oscillation detecting section 10 determines that the luminance of the converted images is oscillating (that is, detects that the luminance of the converted images is oscillating).

The luminance oscillation detecting section 10, in the case where it has detected that the luminance of the converted images is oscillating, supplies an adjustment value fixing control signal to the counter 9. This causes the counter 9 to stop correction of the adjustment value C as described above (that is, fix the adjustment value C to a value achieved at that time point).

The following provides a supplemental description of the process carried out by the luminance oscillation detecting section 10: The luminance oscillation detecting section 10 sequentially stores adjustment values C used by the luminance compression section 1 for luminance compression of input images for three frames. The luminance oscillation detecting section 10 then, with reference to the adjustment values C corresponding to the three frames, detects a change of the adjustment value C over the three frames as described above.

During the above operation, the luminance oscillation detecting section 10, for example, detects, on the basis of the color signals of R, G, and B supplied from the extracting section 12 to the luminance compression section 1, whether the input image for the current frame is identical to the input image for the last frame (for instance, whether the luminance compression section 1 has sequentially received input images identical to each other). The luminance oscillation detecting section 10 then, in the case where it has detected that the input images are identical to each other, (i) stores the adjustment value C used for luminance compression for the current frame, and (ii) detects, with reference to the adjustment value C for the current frame and already stored respective adjustment values C for the last frame and the frame before last, a change of the adjustment value C over the three frames as described above.

The luminance oscillation detecting section 10, in the case where it has detected that the input images are not identical to each other, (i) stores the adjustment value C used for luminance compression for the current frame, and (ii) deletes already stored respective adjustment values C for the last frame and the frame before last. The luminance oscillation detecting section 10, when it has stored the third one of adjustment values C for three frames (namely, the three frames of the current frame, the last frame, and the frame before last), detects a change of the adjustment value C over the three frames with reference to the adjustment values C for the three frames as described above. This operation allows the luminance oscillation detecting section 10 to detect oscillation of luminance of converted images while input images identical to each other are being inputted.

As described above, the luminance oscillation detecting section 10 detects, while input images identical to each other are being inputted, whether the luminance of the corresponding converted images is oscillating. The expression "input images identical to each other" in the above clause "while input images identical to each other are being inputted" may mean input images that are exactly the same as each other. The meaning of the above expression is, however, not limited to that. For instance, input images may be regarded as identical to each other as long as those input images are the same as each other for the most part (for example, 80% to 90% of all the pixels are the same) even if there is a small change in content between the input images. The control signal generating section 13 generates respective control signals for drivingly controlling the source driver 103 and the gate driver 104. The control signal generating section 13 supplies the respective control signals to the source driver 103 and the gate driver 104 on the basis of the sync signals extracted by the extracting section 12.

The backlight control section 14, for example, adjusts the luminance of the backlight 102 for each frame for a converted image or each plurality (5 or 6) of frames for converted images so that the backlight 102 has a luminance equal to a maximum luminance in each converted image. Specifically, the backlight control section 14, on the basis of respective luminances indicated by color signals of R, G, B, and W supplied from the inverse γ correction section 8, detects a maximum luminance in a converted image represented by the color signals, and adjusts the luminance of the backlight 102 so that the backlight 102 has a luminance corresponding to the above maximum luminance. In the case where, for instance, the luminance of the backlight 102 is controlled by PWM, the backlight control section 14 controls the luminance of the backlight 102 by supplying the backlight 102 with data on a duty ratio (luminance control signal) defining the luminance of the backlight 102.

(Operation Description)

The description below deals with the operation of the above liquid crystal display device with reference to FIG. 6.

In the step S1, the extracting section 12 extracts, from video signals inputted thereto from outside, (i) color signals Lin(R, G, B) of R, G, and B and (ii) sync signals. The extracting section 12 then supplies (i) the color signals to the luminance compression section 1 and (ii) the sync signals to the control signal generating section 13.

In the step S2, the luminance compression section 1 selects a luminance compression ratio K (=C/1.35) on the basis of a preset adjustment value C. The luminance compression section 1 carries out luminance compression with respect to the color signals of R, G, and B for the pixels, the color signals having been supplied to the luminance compression section 1, at the luminance compression ratio K to generate post-compression color signals L'(R, G, B) (=Lin(R, G, B)*K) of R, G, and B.

In the step 3, the luminance oscillation detecting section 10 detects whether the input image for the current frame (that is, an image represented by the extracted color signals of R, G, and B) is identical to the input image for the last frame. In other words, the luminance oscillation detecting section 10 detects whether the luminance compression section 1 or extracting section 12, for example, has sequentially received input images identical to each other. In the case where the luminance oscillation detecting section 10 has detected that the input images are identical to each other, the process proceeds to the step S4, whereas in the case where the luminance oscillation detecting section 10 has detected that the input images are not identical to each other, the process proceeds to the step S5.

In the step S4, the luminance oscillation detecting section 10 stores the adjustment value C used for luminance compression of the input image for the current frame. During this step, in the case where the luminance oscillation detecting section 10 has already stored adjustment values C used for luminance compression of respective input images for the last frame and the frame before last, the luminance oscillation detecting section 10 does not delete the already stored adjustment values C.

In the step S5, the luminance oscillation detecting section 10 stores the adjustment value C used for luminance compression of the input image for the current frame. During this step, in the case where the luminance oscillation detecting section 10 has already stored adjustment values C used for luminance compression of respective input images for the last frame and the frame before last, the luminance oscillation detecting section 10 deletes the already stored adjustment values C.

In the step S6, in the case where the luminance oscillation detecting section 10 has stored adjustment values C for three frames (namely, the three frames of the current frame, the last frame, and the frame before last), the luminance oscillation detecting section 10 detects, with reference to the adjustment values C for the three frames, a change of the adjustment value C over the three frames.

In the case where the luminance oscillation detecting section 10 has detected that the adjustment value C has changed as increase→decrease sequentially or that the adjustment value C has changed as decrease→increase sequentially, the luminance oscillation detecting section 10 determines that the adjustment value C has oscillated (that is, detects that the adjustment value C has oscillated). The process then proceeds to the step S7, during which the luminance oscillation detecting section 10 supplies the counter 9, which controls the adjustment value C, with an adjustment value fixing control signal for fixing the adjustment value C (that is, an instruction to fix the adjustment value C). This operation causes the counter 9 to fix an adjustment value C for use in luminance compression of an input image for the subsequent frame as described later (S14). The process then proceeds to the step S8.

In the case where, in the step S6, (i) the luminance oscillation detecting section 10 has not stored adjustment values C for three frames or (ii) the luminance oscillation detecting section 10 has stored adjustment values C for three frames and has detected that a change of the adjustment value C over the three frames is neither a sequential change of increase→decrease nor a sequential change of decrease→increase, the luminance oscillation detecting section 10 determines that the adjustment value C has not oscillated (that is, detects that the adjustment value C has not oscillated). In this case, the luminance oscillation detecting section 10 does not supply the counter 9, which controls the adjustment value C, with an adjustment value fixing control signal for fixing the adjustment value C. The process then proceeds to the step S8.

In the step S8, the determining section 3 calculates, for each pixel, the ratio t=minL'(R, G, B)/maxL'(R, G, B) on the basis of a maximum luminance value maxL'(R, G, B) and a luminance minimum value minL'(R, G, B) indicated by the post-compression color signals L'(R, G, B) of R, G, and B generated by the luminance compression section 1.

In the step S9, the luminance expansion rate S calculating section 4 calculates, for each pixel, a luminance expansion rate $S(=a*t^2+b*t+Cmax)$ with reference to the ratio t calculated by the determining section 3 for each pixel.

In the step S10, the luminance expansion section 6 carries out, for each pixel, luminance expansion with respect to the post-compression color signals L'(R, G, B) of R, G, and B, which are generated by the luminance compression section 1, at the luminance expansion rate S calculated by the luminance expansion rate S calculating section 4. The luminance expansion section 6 then subtracts, from the resulting signals, a minimum luminance value minL'(R, G, B) indicated by the post-compression color signals L'(R, G, B) to generate luminance-expanded converted signals Lout(R, G, B) (=L'(R, G, B)*S−minL'(R, G, B)) of R, G, and B. Further, the W calculating section 7 generates a W signal Lout(W) (=minL'(R, G, B)) with reference to the minimum luminance value minL'(R, G, B) indicated by the color signals indicative of respective luminances as compressed. The above operation converts (i) an input image including pixels indicated by color signals Lin(R, G, B) of R, G, and B into (ii) a converted image including pixels indicated by color signals Lout(R, G, B, W) of R, G, B, and W.

In the step S11, the counter 9 counts, for each of the colors of R, G, and B separately, picture elements in a state of luminance saturation on the basis of the luminance-expanded converted signals Lout(R, G, B) of R, G, and B generated by the luminance expansion section 6 for the pixels of the converted image for the current frame.

In the step S12, in the case where the process did not perform the step S7 before arriving at the step S12 (that is, the luminance oscillation detecting section 10 did not supply a luminance fixing control signal to the counter 9), the process proceeds to the step S13, during which the counter 9 may correct (increase or decrease) an adjustment value C for use in luminance compression of an input image for the subsequent frame in correspondence with the count made during the step S11.

In the step S12, in the case where the process did perform the step S7 before arriving at the step S12 (that is, the luminance oscillation detecting section 10 did supply a luminance fixing control signal to the counter 9), the process proceeds to the step S14, during which the counter 9 fixes an adjustment value C for use in luminance compression of an input image for the subsequent frame to a certain value (for example, the adjustment value C used for luminance compression of the input image for the current frame) for a predetermined time period, for example. This operation stops oscillation of the adjustment value C while the adjustment value C is fixed, and as a result, prevents luminance oscillation in a converted image to be displayed during the steps S16 and S17 described later, the luminance oscillation arising from oscillation of the adjustment value C.

In the step S15, the inverse γ correction section 8 (i) carries out inverse γ correction with respect to the color signals Lout(R, G, B, W) of R, G, B, and W generated by the luminance expansion section 6 and the W calculating section 7, and (ii) supplies the source driver 103 with the color signals Lout(R, G, B, W) thus having been subjected to inverse γ correction.

In the step S16, the control signal generating section 13 (i) generates respective control signals for controlling the source driver 103 and the gate driver 104, and (ii) supplies the respective control signals to the source driver 103 and the gate driver 104 on the basis of the sync signals extracted by the extracting section 12.

In the step S17, the backlight control section 14 controls the luminance of the backlight 102 on the basis of the color signals Lout(R, G, B, W) of R, G, B, and W having been subjected to inverse γ correction.

The steps S15 through S17 cause the liquid crystal panel 110*a* to display a converted image represented by color signals of R, G, B, and W generated by the luminance expansion section 6 and the W calculating section 7.

(Effects)

As described above, the present embodiment adjusts an adjustment value C for use in luminance compression of an input image for the subsequent frame in correspondence with the state of luminance saturation of the pixels in a converted image converted from an input image for the current frame (that is, carries out feedback control of the adjustment value C). The present embodiment can thus display a converted image while preventing the state of luminance saturation.

Such feedback control of the adjustment value C may, however, cause the adjustment value C to oscillate and consequently cause the luminance of the converted image to oscillate. The present embodiment, in view of this problem, detects oscillation of the adjustment value C, and in the case where it has detected oscillation of the adjustment value C, the present embodiment fixes an adjustment value C for use in luminance compression of an input image for the subsequent frame to a certain value. This arrangement prevents luminance oscillation in a converted image, the luminance oscillation arising from oscillation of the adjustment value C.

The present embodiment, which involves a single fixed luminance expansion curve, first compresses luminance before luminance expansion and changes the compression ratio in correspondence with a video-image scene to carry out luminance expansion that is the most suitable for the video-image scene. The present embodiment can thus expand the luminance of a primary color as well at least to a certain degree. This arrangement achieves the advantage of, in the case where a primary color and white are adjacent to each other, minimizing perception of chroma decrease for the primary color.

The present embodiment carries out luminance expansion with respect to R, G, and B signals themselves, and subtracts a W component from the resulting signals. This arrangement minimizes chroma decrease caused by application of a W signal. Further, the present embodiment, in the case where t=1 (that is, in the case of carrying out a gray display or white display, for which the respective luminances of R, G, and B are equal to one another), allows the luminance of W to be equal to those of R, G, and B. This arrangement can prevent a white (light) spot during a gray display, and can thus improve display quality.

In addition, the present embodiment selects a luminance compression ratio K for R, G, and B on the basis of information on luminance of each separate color (that is, the number of picture elements in the state of luminance saturation for each separate color). The present embodiment can thus calculate a luminance compression ratio that is the most suitable for the video-image scene. The present embodiment can, by carrying out luminance expansion with respect to the signals indicative of respective luminances as compressed at the luminance compression ratio thus calculated, carry out luminance expansion that is the most suitable for the video-image scene.

The present invention differs from Patent Literature 1 on the following point: Patent Literature 1 includes a W picture element smaller in size than any of R, G, and B picture elements to simultaneously improve luminance and maintain chroma. On the other hand, the present invention, in computing R, G, B, and W input signals from R, G, and B input signals, calculates the most suitable luminance expansion rate to calculate R, G, B, and W signals. This arrangement prevents a loss in luminance increase from being caused by a smaller size of the W picture element.

The present invention differs from Patent Literature 2 on the following point: Patent Literature 2 extracts a white component from an input signal, and simply subtracts the white component from the input signal. This arrangement problematically fails to expand luminance or prevent chroma decrease. Patent Literature 2, which discloses a technique for non-linearizing a white component only, does not carry out luminance expansion with respect to input R, G, and B signals themselves. This technique will not produce an increase in luminance of display.

The present invention first carries out luminance compression with respect to input signals. The present invention extracts a white component from the resulting signals, carries out luminance expansion with respect to the signals indicative of luminances as compressed, and then subtracts a white component from the resulting signals. This arrangement makes it possible to (i) expand luminance of a single color (that is, a primary color) and also (ii) prevent chroma decrease. The present invention avoids simply carrying out luminance compression and luminance expansion with respect to input signals to process data in a nonlinear manner.

The present invention differs from Patent Literature 3 on the following point: Patent Literature 3 calculates a luminance expansion rate for each color separately, whereas the present invention involves a common luminance expansion rate for R, G, and B. Patent Literature 3 is completely incapable of expanding the luminance of a primary color, whereas the present invention is capable of expanding even the luminance of a primary color to a certain degree.

The description below deals with examples of conversion from R, G, and B signals to R, G, B, and W signals. The following shows results of the conversion for the case of (Rin, Gin, Bin)=(255, 128, 64).

Patent Literature 3 (calculated with γ=2.2) provides (Rout, Gout, Bout, Wout)=(255, 117, 16, 64).

Patent Literature 2 provides (i) (Rout, Gout, Bout, Wout)=(191, 64, 0, 64) without nonlinear processing for W and (ii) (Rout, Gout, Bout, Wout)=(247, 120, 56, 8) with nonlinear processing described in the Examples.

Second converting means (calculated with γ=2.2) described below provides (i) (Rout, Gout, Bout, Wout)=(255, 118, 16, 64) in the case where C=1, (ii) (Rout, Gout, Bout, Wout)=(277, 130, 30, 64) in the case where C=1.2, and (iii) (Rout, Gout, Bout, Wout)=(292, 138, 42, 64) in the case where C=1.35.

The present invention (calculated with γ=2.2) provides (i) (Rout, Gout, Bout, Wout)=(255, 120, 36, 55) in the case where C=1, (ii) (Rout, Gout, Bout, Wout)=(277, 131, 40, 60) in the case where C=1.2, and (iii) (Rout, Gout, Bout, Wout)=(292, 138, 42, 64) in the case where C=1.35.

The following shows results of the conversion for the case of (Rin, Gin, Bin)=(128, 128, 128) displaying an intermediate gray.

Patent Literature 3 (calculated with γ=2.2) provides (Rout, Gout, Bout, Wout)=(128, 128, 128, 128).

Patent Literature 2 provides (i) (Rout, Gout, Bout, Wout)=(0, 0, 0, 128) without nonlinear processing for W and (ii) (Rout, Gout, Bout, Wout)=(83, 83, 83, 45) with nonlinear processing described in the Examples.

The second converting means (calculated with γ=2.2) described below provides (i) (Rout, Gout, Bout, Wout)=(105, 105, 105, 128) in the case where C=1, (ii) (Rout, Gout, Bout, Wout)=(118, 118, 118, 128) in the case where C=1.2, and (iii) (Rout, Gout, Bout, Wout)=(128, 128, 128, 128) in the case where C=1.35.

The present invention (calculated with γ=2.2) provides (i) (Rout, Gout, Bout, Wout)=(111, 111, 111, 111) in the case where C=1, (ii) (Rout, Gout, Bout, Wout)=(121, 121, 121, 121) in the case where C=1.2, and (iii) (Rout, Gout, Bout, Wout)=(128, 128, 128, 128) in the case where C=1.35.

The following shows results of four-color color signals as converted for the case of (Rin, Gin, Bin)=(255, 255, 255) displaying white.

Patent Literature 3 (calculated with γ=2.2) provides (Rout, Gout, Bout, Wout)=(255, 255, 255, 255).

Patent Literature 2 provides (i) (Rout, Gout, Bout, Wout)=(0, 0, 0, 255) without nonlinear processing for W and (ii)

(Rout, Gout, Bout, Wout)=(0, 0, 0, 255) with nonlinear processing described in the Examples.

The second converting means (calculated with γ=2.2) described below provides (i) (Rout, Gout, Bout, Wout)=(209, 209, 209, 255) in the case where C=1, (ii) (Rout, Gout, Bout, Wout)=(236, 236, 236, 255) in the case where C=1.2, and (iii) (Rout, Gout, Bout, Wout)=(255, 255, 255, 255) in the case where C=1.35.

The present invention (calculated with γ=2.2) provides (i) (Rout, Gout, Bout, Wout)=(223, 223, 223, 223) in the case where C=1, (ii) (Rout, Gout, Bout, Wout)=(242, 242, 242, 242) in the case where C=1.2, and (iii) (Rout, Gout, Bout, Wout)=(255, 255, 255, 255) in the case where C=1.35.

The inventors of the present invention have devised a color signal converting method as second converting means for converting R, G, and B signals into R, G, B, and W signals. This method first (i) converts input color signals each indicative of a gray-scale level into processed color signals (L') each indicative of a luminance, and then (ii) computes an output luminance by the following equations:

$$Lout(R,G,B)=L'(R,G,B)*S-\min(L'(R,G,B)),$$

$$Lout(W)=\min(L'(R,G,B)),$$

$$S=a*t^2+b*t+C, \text{ and}$$

$$t=\min(L'(R,G,B))/\max(L'(R,G,B))$$

The method carries out inverse γ conversion with respect to Lout to determine color signal outputs indicative of respective gray-scale levels for the colors of R, G, B, and W. The symbol "C" represents a constant of 1 to 1.35, and changes under the following conditions: The method counts pixels each having a gray scale level of higher than 255 for each of the colors of R, G, and B for one frame, and sets C (i) as C=C−0.05 for the subsequent frame in the case where the count exceeds 2% of all the dots, (ii) as C=C+0.05 for the subsequent frame in the case where the count is 0, and (iii) unchanged for the subsequent frame under any other condition.

This method involves a plurality of luminance expansion curves, and changes the luminance expansion curves in correspondence with the scene to carry out luminance expansion that is the most suitable for the video-image scene. The present embodiment can thus expand the luminance of a primary color as well at least to a certain degree. This arrangement achieves the advantage of, in the case where a primary color and white are adjacent to each other, minimizing perception of chroma decrease of the primary color. Further, the present embodiment carries out luminance expansion with respect to R, G, and B signals themselves, and subtracts a W component from the resulting signals. This arrangement minimizes chroma decrease caused by application of a W signal.

The above second converting means, however, provides R=G=B<W during a gray or white output in any case other than C=1.35 as described above, and may cause only an output for a W picture element to have a high gray-scale level. This may lead to a halftone gray display in particular to have a white (light) spot caused by a W picture element, thereby decreasing display quality.

The conditions for changing C do not involve a counter of a gray-scale level of over 255 for each color separately, and may thus reduce the luminance expansion rate by a degree more than necessary. This disadvantageously (i) makes it impossible to display a sharp video image and (ii) decreases quality of a video image displayed.

The present invention, on the other hand, provides R=G=B=W even during a gray or white output, which prevents a light spot in display. Further, the present invention applies conditions for changing C for each color separately, which also prevents the luminance expansion rate from being reduced by a degree more than necessary. The present invention can thus avoid the above disadvantages.

In other words, the above second converting means is characterized to involve eight luminance expansion curves and select luminance expansion curves for the subsequent frame on the basis of luminance information for the current frame. The second converting means counts up C commonly for all of R, G, and B to provide luminance information for the current frame.

The present invention is, on the other hand, characterized to involve a single luminance expansion curve. The present invention is further characterized to carry out luminance compression in eight different manners instead of involving eight luminance expansion curves as used by the second converting means, and to select a degree of luminance compression for the subsequent frame on the basis of luminance information for the current frame.

The present invention is characterized to process luminance information for the current frame for each of R, G, and B separately and set a flag. The present invention is arranged to cause the luminance expansion curve to meet R=G=B=W during white and gray outputs. The present invention can thus avoid, during a gray display, a white spot as caused in the case where the second converting means is used. Further, the present invention processes luminance information for the current frame for each color separately. This arrangement makes it possible to prevent luminance expansion from being erroneously reduced by a degree more than necessary.

The above embodiment has discussed an example involving a liquid crystal panel as a display section. The display section is, however, not limited to any particular one, and may be any color display section that carries out additive color mixture. Examples of the color display section include, other than a liquid crystal panel, (i) an emissive flat-panel display such as a plasma display (PDP) and an electroluminescent display (EL) and (ii) a CRT (cathode ray tube) display including what is called a Braun tube.

A PDP, an EL display, and a CRT display can each use luminous efficiencies for respective pixels of individual colors in place of the light transmittances (namely, Tc and Tw) used for the liquid crystal panel 101 including color filters.

(Variation)

The present variation is a variation of Embodiment 1.

Figure 7:
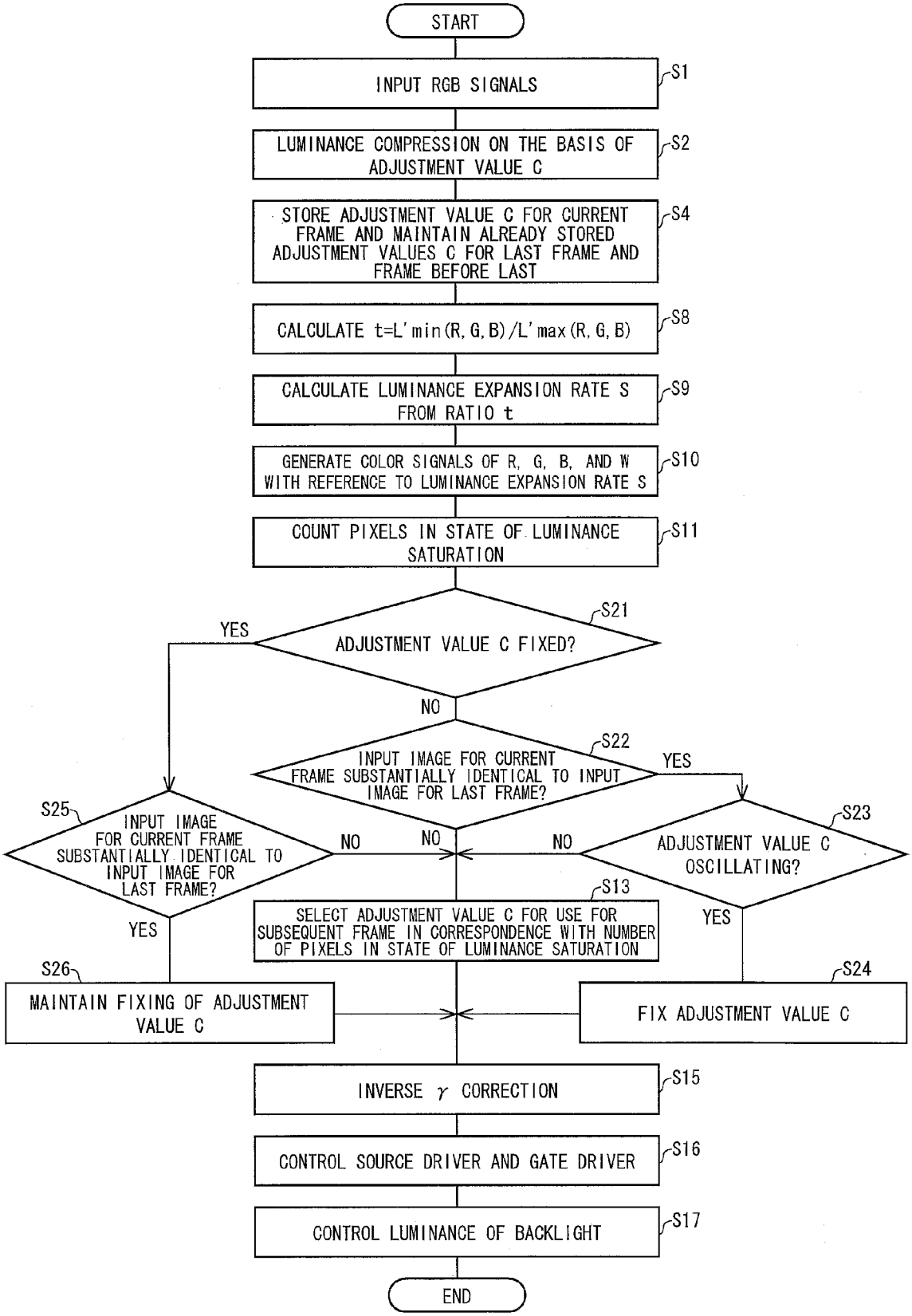
FIG. 7 is a flowchart illustrating the operation of a liquid crystal display device of a variation of Embodiment 1 of the present invention.

The present variation is identical in configuration to Embodiment 1, but is different in operation from Embodiment 1. FIG. 7 is a flowchart illustrating the operation of a liquid crystal display device of the present variation.

Figure 6:
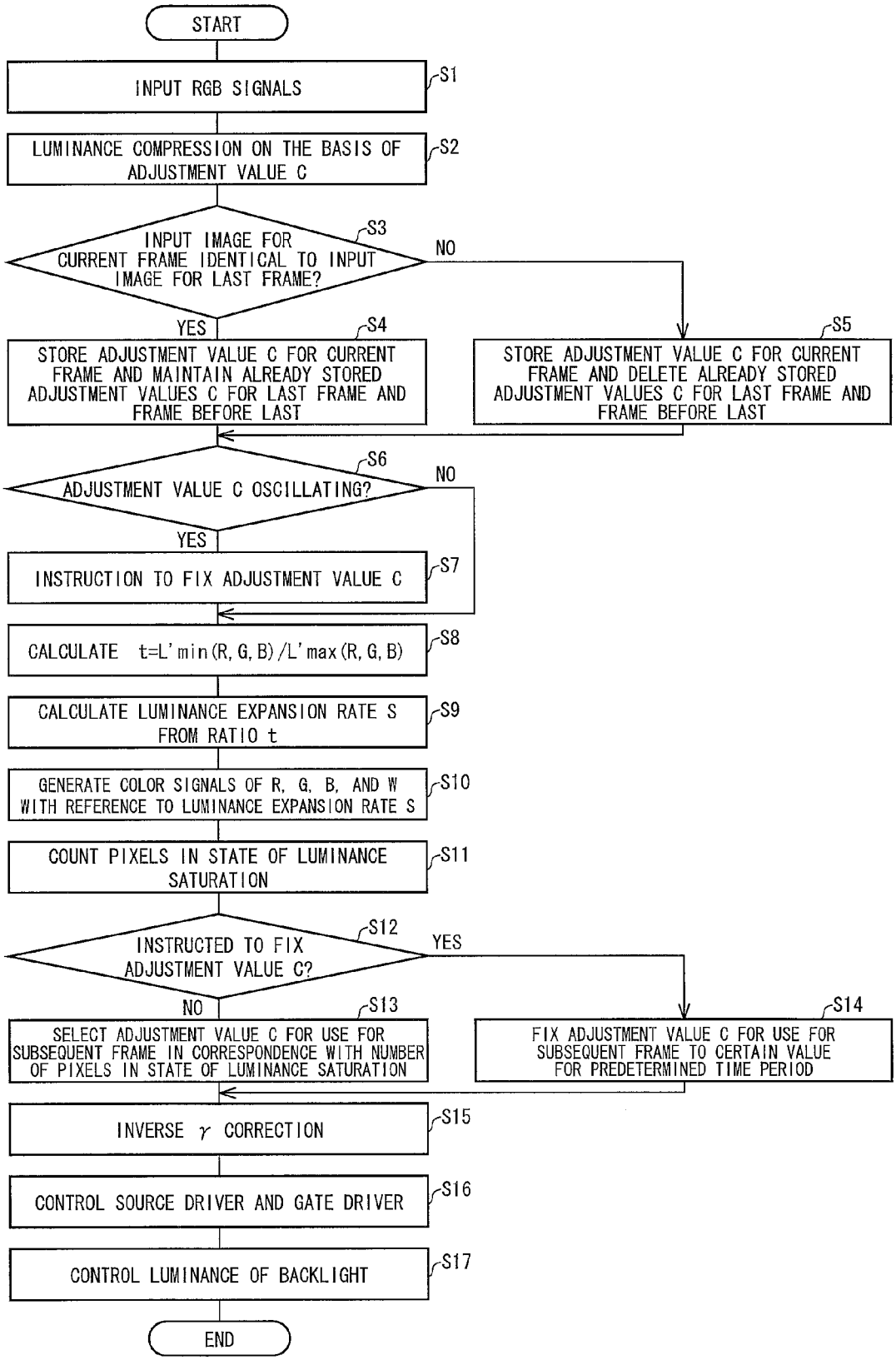
FIG. 6 is a flowchart illustrating the operation of the liquid crystal display device of Embodiment 1 of the present invention.

The flowchart of FIG. 7 is different from that of FIG. 6 (that is, the operation in Embodiment 1) in that the flowchart of FIG. 7 does not include the steps S3, S5 to S7, S12, and S14 and includes steps S21 to S26. The description below assigns, to any step in FIG. 7 which step is identical to a corresponding step in FIG. 6, a symbol identical to that assigned to the corresponding step, and does not deal with such identical steps. The description below mainly deals with steps in the flowchart of FIG. 7 that are not included in the flowchart of FIG. 6.

The operation illustrated in FIG. 6 deletes already stored adjustment values C in the case where the input image for the last frame is not (substantially) identical to the input image for the current frame (S5). The operation illustrated in FIG. 7 is, on the other hand, arranged to not delete already stored adjustment values C even in the case where the input image for the last frame is not (substantially) identical to the input image for the current frame. In other words, the operation illustrated in FIG. 7 stores an adjustment value C for each frame regardless of the input image (that is, even in the case where the input image for the current frame is not identical to the input image for the last frame). Further, the operation illustrated in FIG. 6 cancels fixing of the adjustment value C automatically a predetermined time period after the adjustment value C becomes fixed (S14). The operation illustrated in FIG. 7 is, in contrast, arranged to cancel fixing of the adjustment value C automatically in the case where the input image for the current frame stops being (substantially) identical to the input image for the last frame after the adjustment value C becomes fixed.

The process illustrated in the flowchart of FIG. 7 first carries out steps S1 and S2, and proceeds to the step S4, to the steps S8 through S11, and then to the step S21.

In the step S21, in the case where (i) the counter 9 has not already fixed the adjustment value C (NO in S21), the process proceeds to the step S22, and in the case where (ii) the counter 9 has already fixed the adjustment value C (YES in S21), the process proceeds to the step S25.

In the step S22, the luminance oscillation detecting section 10 (luminance oscillation detecting means, detecting means) detects whether the input image for the current frame is (substantially) identical to the input image for the last frame. In other words, the luminance oscillation detecting section 10 detects whether the luminance compression section 1 or extracting section 12, for example, has received input images (substantially) identical to each other. In the case where the luminance oscillation detecting section 10 has detected that the input images are (substantially) identical to each other (YES in S22), the process proceeds to the step S23. In the case where the luminance oscillation detecting section 10 has detected that the input images are not (substantially) identical to each other (NO in S22), the process proceeds to the step S13.

In the step S23, the luminance oscillation detecting section 10, with reference to stored adjustment values C for three frames, detects a change of the adjustment value C over the three frames. In the case where the luminance oscillation detecting section 10 has detected that the adjustment value C has changed as increase→decrease sequentially or that the adjustment value C has changed as decrease→increase sequentially, the luminance oscillation detecting section 10 determines that the adjustment value C has oscillated (that is, detects that the adjustment value C has oscillated).

In the step S23, in the case where the luminance oscillation detecting section 10 has determined that the adjustment value C has oscillated (YES in S23), the process proceeds to the step S24, during which the luminance oscillation detecting section 10 supplies the counter 9 (luminance control means, luminance fixing means), which controls the adjustment value C, with an adjustment value fixing control signal for fixing the adjustment value C. This operation causes the counter 9 to fix an adjustment value C for use in luminance compression of an input image for the subsequent frame. The process then proceeds to the step S15.

In the step S23, in the case where the luminance oscillation detecting section 10 has detected that a change of the adjustment value C over the three frames is neither a sequential change of increase→decrease nor a sequential change of decrease→increase, the luminance oscillation detecting section 10 determines that the adjustment value C has not oscillated (that is, detects that the adjustment value C has not oscillated) (NO in S23). In this case, the luminance oscillation detecting section 10 does not supply the counter 9, which controls the adjustment value C, with an adjustment value fixing control signal for fixing the adjustment value C. The process then proceeds to the step S13.

In the step S25, as well as the step S22, the luminance oscillation detecting section 10 detects whether the input image for the current frame is (substantially) identical to the input image for the last frame. In the case where the luminance oscillation detecting section 10 has detected that the input images are (substantially) identical to each other (YES in S25), the process proceeds to the step S26. In the case where the luminance oscillation detecting section 10 has detected that the input images are not (substantially) identical to each other (NO in S25), the luminance oscillation detecting section 10 supplies the counter 9 with data on the detection result. The process then proceeds to the step S13. In the step S13, the counter 9, which has received the data on the detection result, selects an adjustment value C in correspondence with the number of pixels in the converted image as converted from the input image for the current frame which pixels are in a saturated-luminance state. (that is, the counter 9 cancels the fixing of the adjustment value C).

In the step S26, the counter 9 maintains the fixing of the adjustment value C. This maintains the fixing of an adjustment value C for use in luminance compression of an input image for the subsequent frame. The process then proceeds to the step S15.

As described above, according to the operation illustrated in FIG. 7, in the case where the input image for the current frame has become not (substantially) identical to the input image for the last frame (No in S25) while the adjustment value C is fixed (Yes in S21), the adjustment value C is selected in correspondence with the number of pixels in the converted image as converted from the input image for the current frame which pixels are in the saturated-luminance state (that is, the fixing of the adjustment value C is canceled, and the adjustment value C is computed again) (S13). Further, according to the operation illustrated in FIG. 7, while the input image for the current frame remains (substantially) identical to the input image for the last frame while the adjustment value C is fixed (Yes in S21), the fixing of the adjustment value C is maintained (S26).

As with the operation illustrated in FIG. 6, according to the operation illustrated in FIG. 7, in the case where the input image for the current frame is (substantially) identical to the input image for the last frame (Yes in S22) while the adjustment value C is not fixed (No in S21), the adjustment value C is fixed (S24) if oscillation of the adjustment value C is detected (S23). In the case where the input image for the current frame is not (substantially) identical to the input image for the last frame (No in S22) while the adjustment value C is not fixed (No in S21), the adjustment value C is not fixed (S13).

In the steps S22 and S25, whether the input image for the current frame is (substantially) identical to the input image for the last frame may be determined by, for example, (i) a method similar to the determination method used during the step S3 in FIG. 6 or (ii) any one of the determination methods (a) to (c) below.

(a) The input image for the current frame and the input image for the last frame are (substantially) identical to each other in the case where respective luminance averages of the two input images have a difference therebetween that is less than a predetermined threshold (for example, 20%)

(b) The input image for the current frame and the input image for the last frame are (substantially) identical to each other in the case where the respective numbers of pixels in the two input images which pixels are in the state of luminance saturation have a difference therebetween that is less than a predetermined threshold (for example, 10%)

(c) The input image for the current frame and the input image for the last frame are (substantially) identical to each other in the case where the respective numbers of pixels in the two input images which pixels each have a ratio t (=minL'(R, G, B)/maxL'(R, G, B)) of greater than a first threshold (for example, 0.1) have a difference therebetween that is less than a second threshold (for example, 30%)

The present variation is, as described above, similar to Embodiment 1 in that it detects oscillation of the adjustment value C, and in the case where it has detected oscillation of the adjustment value C, the present variation fixes an adjustment value C for use in luminance compression of an input image for the subsequent frame to a certain value. This arrangement prevents luminance oscillation in a converted image, the luminance oscillation arising from oscillation of the adjustment value C.

Embodiment 2

Figure 8:
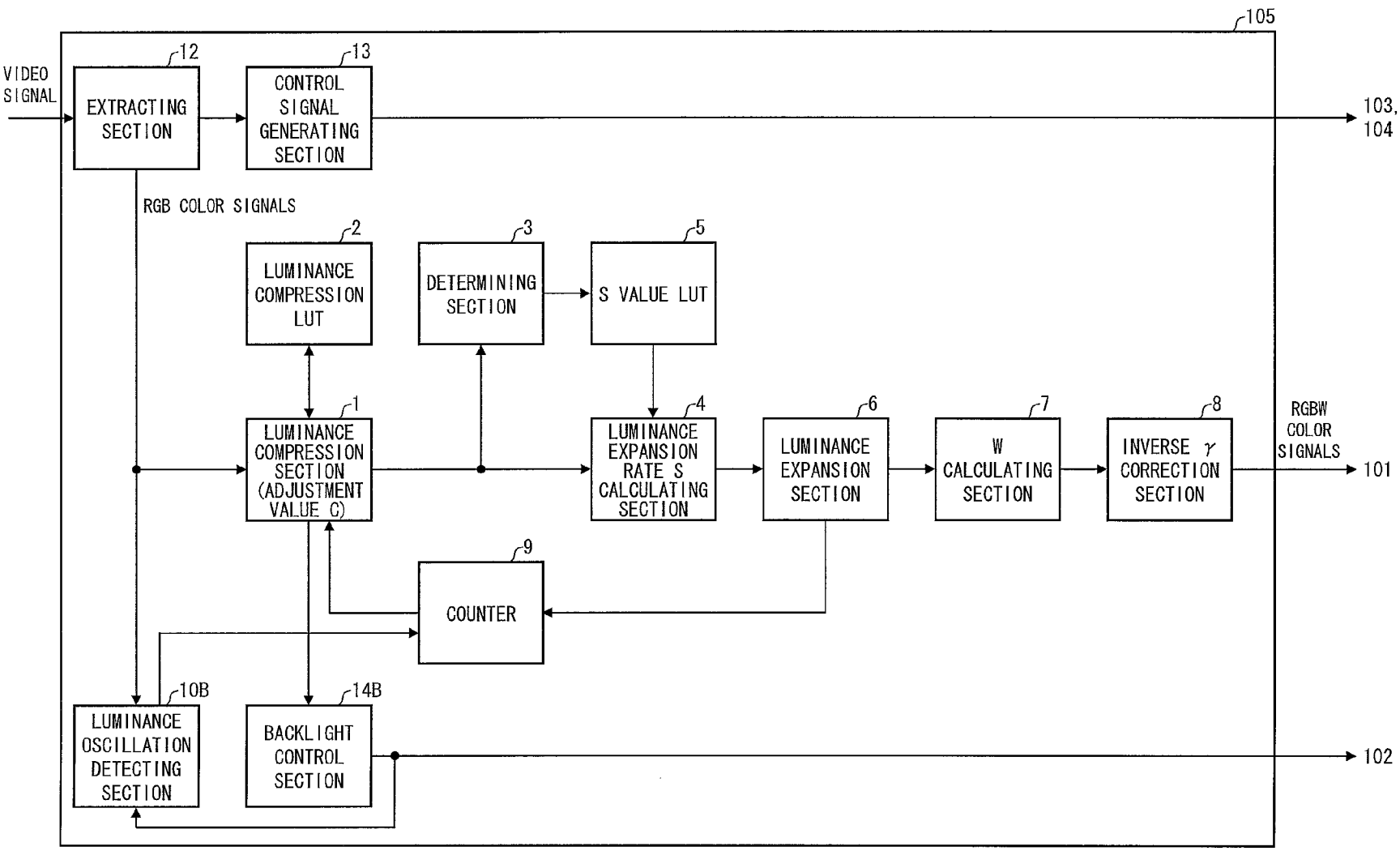
FIG. 8 is a diagram schematically illustrating a controller included in a liquid crystal display device of Embodiment 2 of the present invention.
Figure 9:
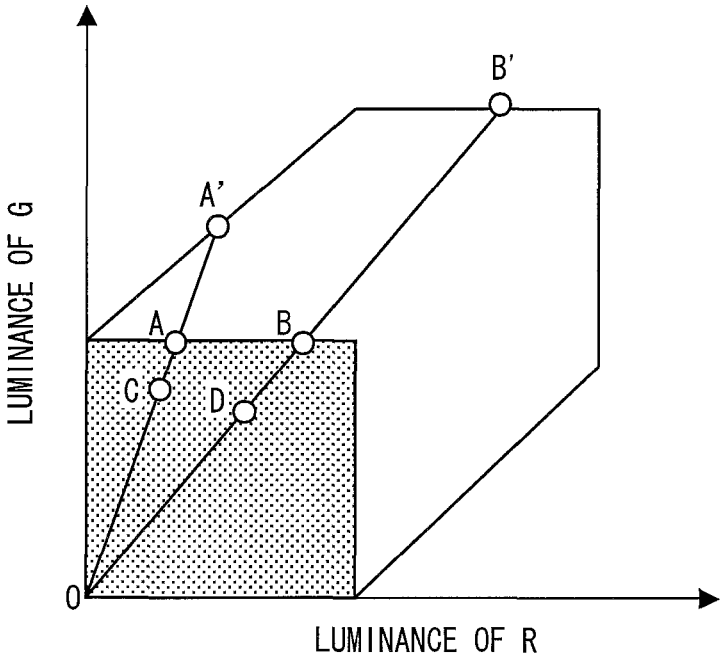
FIG. 9 PRIOR ART
FIG. 9 is a graph illustrating a conventional process of converting three colors into four colors.
Figure 10:
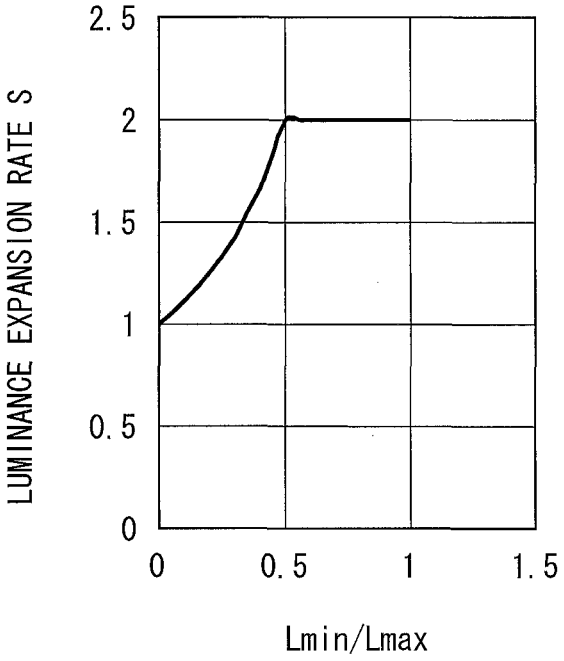
FIG. 10 PRIOR ART
FIG. 10 is a graph illustrating another conventional process of converting three colors into four colors.

The present embodiment describes a liquid crystal display device 110B that is identical in arrangement to the liquid crystal display device of Embodiment 1 except that the liquid crystal display device 110B includes a backlight control section 14B and a luminance oscillation detecting section 10B each of which carries out processing different from that carried out by its corresponding member in Embodiment 1. The description below deals in detail with the present embodiment with reference to FIG. 8. The description below assigns, to any constituent element of the present embodiment which constituent element is identical to a corresponding constituent element of Embodiment 1, a reference numeral identical to that assigned to the corresponding constituent element, and does not deal with such identical constituent elements. The description below mainly deals with constituent elements of the present embodiment that are not included in Embodiment 1.

The backlight control section 14B (illumination control means) of the present embodiment controls the luminance of the backlight 102 on the basis of the adjustment value C (that is, information on the luminance of a converted image), for example, the adjustment value C used for luminance compression of the input image for the last frame.

Specifically, an increase in the adjustment value C decreases the luminance compression ratio K, and thus raises the respective gray-scale levels of R, G, and B in a converted image to increase the respective luminances of R, G, and B. The backlight control section 14 thus controls the backlight 102 for decreased luminance to prevent an increase in the display luminance (that is, the luminance of a display image). In other words, the backlight control section 14 supplies the backlight 102 with a luminance control signal for decreasing the luminance of the backlight 102. A display image refers to an image displayed by the backlight 102 illuminating the liquid crystal panel 101 on which a converted image is being displayed.

On the other hand, a decrease in the adjustment value C increases the luminance compression ratio K, and thus lowers the respective gray-scale levels of R, G, and B in a converted image to decrease the respective luminances of R, G, and B. The backlight control section 14 thus controls the backlight 102 for increased luminance to prevent a decrease in the display luminance. In other words, the backlight control section 14 supplies the backlight 102 with a luminance control signal for decreasing the luminance of the backlight 102. The backlight 102 changes its luminance in accordance with a luminance control signal from the backlight control section 14B.

The luminance oscillation detecting section 10B (luminance oscillation detecting means) of the present embodiment detects, while, for instance, the luminance compression section 1 is receiving input images that are identical (or substantially identical) to each other, whether the luminance of the corresponding converted images is oscillating. The luminance oscillation detecting section 10B of the present embodiment detects, on the basis of a luminance control signal supplied from the backlight control section 14B to the backlight 102, whether the luminance of the converted images is oscillating.

In other words, the present embodiment is arranged such that since an oscillating adjustment value C causes the luminance of the backlight 102 to oscillate, the luminance oscillation detecting section 10B refers to a luminance control signal, which is a signal for controlling the luminance of the backlight 102, to detect oscillation of the luminance of converted images.

Specifically, the luminance oscillation detecting section 10B stores, for, for example, three consecutive frames (that is, the three frames of the current frame, the last frame, and the frame before last), a luminance control signal supplied from the backlight control section 14B to the backlight 102 during display of the converted image for each frame. The luminance oscillation detecting section 10B then (i) detects the luminance of the backlight 102, the luminance being indicated by each of the luminance control signals for the three frames, and thus (ii) detects a luminance change over the three frames. In the case where the change has a pattern of increase→decrease or decrease→increase, the luminance oscillation detecting section 10B determines that the luminance of the backlight 102 is oscillating (that is, detects that the luminance of the backlight 102 is oscillating). The luminance oscillation detecting section 10B, by detecting that the luminance of the backlight 102 is oscillating, detects that the luminance of converted images is oscillating.

The luminance oscillation detecting section 10, in the case where it has detected that the luminance of converted images is oscillating, supplies the counter 9 with an adjustment value fixing control signal as in Embodiment 1. This causes the counter 9 to stop correction of the adjustment value C as in Embodiment 1 (that is, fix the adjustment value C to a value achieved at that time point). This in turn not only stops oscillation of the luminance of the backlight 102, but also stops oscillation of the respective gray-scale levels of R, G, and B in converted images as in Embodiment 1, thereby stopping oscillation of the luminance of converted images.

The luminance of the backlight 102 is oscillated as a result of oscillation of the adjustment value C. Such oscillation of the adjustment value C oscillates causes not only the luminance of the backlight 102 to oscillate, but also the respective gray-scale levels of R, G, and B in converted images to oscillate. These oscillations in turn cause the luminance of the converted images to oscillate. The present embodiment is, in view of this, arranged such that in the case where the luminance oscillation detecting section 10 has detected oscillation of the luminance of converted images, the counter 9 fixes the adjustment value C in order to stop oscillation of the luminance of converted images. In the present embodiment, fixing the adjustment value C stops oscillation of the luminance of the backlight 102.

The present embodiment is, as described above, arranged as follows: Oscillation of the adjustment value C causes the luminance of the backlight 102 to oscillate. This oscillation is one factor for oscillation of the luminance of a display image. Such oscillation of the luminance of a display image is detected by the luminance oscillation detecting section 10B with use of a luminance control signal. The luminance oscillation detecting section 10B causes the counter 9 to fix the adjustment value C to a certain value. This operation stops oscillation of the respective gray-scale levels of R, G, and B in converted images and oscillation of the luminance of the backlight, the oscillations being caused by oscillation of the adjustment value C. The above operation, as a result, stops oscillation of the luminance of a display image.

The display device of the present invention may desirably further include: a non-self-light-emitting display section; illumination means for illuminating the display section with light having a luminance based on a luminance control signal; display control means for displaying the converted image at the display section; and illumination control means for (i) generating the luminance control signal, which controls the luminance of the illumination means, on a basis of information for determining the luminance of the converted image and (ii) supplying the luminance control signal to the illumination means, wherein the luminance oscillation detecting means, by detecting on a basis of the luminance control signal whether the luminance of the illumination means is oscillating, detects whether the converted images have an oscillating luminance.

The above arrangement further includes illumination control means for (i) generating the luminance control signal, which controls the luminance of the illumination means, on a basis of information for determining the luminance of the converted image and (ii) supplying the luminance control signal to the illumination means, the luminance oscillation detecting means, by detecting on the basis of the luminance control signal whether the luminance of the illumination means is oscillating, detects whether the converted images have an oscillating luminance. The above arrangement thus makes it possible to, by detecting on the basis of a luminance control signal whether the luminance of the illumination means is oscillating, detect whether the converted images have an oscillating luminance. The above arrangement consequently makes it possible to detect oscillation of the luminance of the converted image with use of a luminance control signal for controlling the luminance of the illumination means. The above information on the luminance of the converted image can be the set value.

The display device of the present invention may desirably be arranged such that the luminance fixing means fixes the luminance of the converted image as displayed, by fixing the luminance of the illumination means.

According to the above arrangement, the luminance fixing means fixes the luminance of the converted image as displayed, by fixing the luminance of the illumination means. The above arrangement thus makes it possible to, by fixing the luminance of the illumination means, fix the luminance of the converted image appropriately. The above arrangement may fix the luminance of the illumination means by causing the luminance fixing means to control the illumination control means.

The display device of the present invention may desirably be arranged such that the luminance fixing means fixes the luminance of the converted image as displayed, by fixing the set value.

According to the above arrangement, the luminance fixing means fixes the luminance of the converted image as displayed, by fixing the set value. The above arrangement thus makes it possible to fix the luminance of the converted image with use of the set value.

The display device of the present invention may desirably be arranged such that the luminance oscillation detecting means (i) obtains luminance control signals, each being the luminance control signal, corresponding to converted images for three consecutive frames and (ii) in a case where there has been a sequential change of an increase and a decrease in the luminance of the illumination means over the three frames or a sequential change of a decrease and an increase in the luminance of the illumination means over the three frames, determines that the luminance oscillation detecting means has detected that the luminance of the illumination means is oscillating.

The above arrangement (i) obtains luminance control signals corresponding to converted images for three consecutive frames and (ii) in a case where there has been a sequential change of an increase and a decrease in the luminance of the illumination means over the three frames or a sequential change of a decrease and an increase in the luminance of the illumination means over the three frames, determines that the luminance oscillation detecting means has detected that the luminance of the illumination means is oscillating. The above arrangement thus makes it possible to detect oscillation of the luminance of the illumination means with use of the control signal.

The display device of the present invention may desirably be arranged such that the luminance oscillation detecting means (i) obtains set values, each being the set value, corresponding to converted images for three consecutive frames and (ii) in a case where there has been a sequential change of an increase and a decrease in the set values for the three respective frames or a sequential change of a decrease and an increase in the set values for the three respective frames, determines that the luminance oscillation detecting means has detected that the converted images have an oscillating luminance.

The above arrangement (i) obtains set values corresponding to converted images for three consecutive frames and (ii) in a case where there has been a sequential change of an increase and a decrease in the set values corresponding to the converted images over the three frames or a sequential change of a decrease and an increase in the set values corresponding to the converted images over the three frames, determines that the luminance oscillation detecting means has detected that the converted images have an oscillating luminance. The above arrangement thus makes it possible to detect oscillation of the luminance of the converted image with use of the set value.

The display device of the present invention may desirably further include: detecting means for detecting whether the converting means is sequentially receiving input images that are substantially identical to each other, wherein the luminance fixing means, in a case where, after the luminance fixing means has fixed the luminance of the converted image, the detecting means has detected that the converting means is sequentially receiving input images that are not substantially identical to each other, cancels the fixing.

According to the above arrangement, (i) the detecting means detects whether the converting means is sequentially receiving input images that are substantially identical to each other, and (ii) the luminance fixing means, in the case where, after the luminance fixing means has fixed the luminance of the converted image, the detecting means has detected that the converting means is sequentially receiving input images that are not substantially identical to each other, cancels the fixing. The above arrangement thus makes it possible to cancel the fixing of the luminance of the converted image in the case where the converting means is receiving input images that are not substantially identical to each other.

More specifically, in the case where the converting means is receiving input images that are not substantially identical to each other, the converted images can naturally have an oscillating luminance. Such luminance oscillation is not problematic. In this case, the luminance of the converted image thus does not need fixing. The above arrangement, in view of this, cancels the fixing of the luminance of the converted image in the case where the converting means is receiving input images that are substantially identical to each other.

The display device of the present invention may desirably be arranged such that the luminance fixing means, a predetermined time period after the luminance fixing means has fixed the luminance of the converted image as displayed, cancels the fixing.

According to the above arrangement, the luminance fixing means, a predetermined time period after the luminance fixing means has fixed the luminance of the converted image, cancels the fixing. The above arrangement thus makes it possible to cancel the fixing through a simple process of timing the predetermined time period.

The display device of the present invention may desirably further include: luminance control means for (i) decreasing the set value for use in a subsequent conversion in a case where the converted image, which has a luminance as converted by the converting means, includes a first number of a pixel having a state of luminance saturation which first number is larger than a first threshold number and (ii) increasing the set value for use in the subsequent conversion in a case where the converted image includes a second number of the pixel having the state of luminance saturation which second number is not larger than a second threshold number that is not larger than the first threshold number.

According to the above arrangement, the luminance control means (i) decreases the set value in the case where the converted image includes a first number of a pixel having a state of luminance saturation which first number is larger than a first threshold number and (ii) increases the set value in the case where the converted image includes a second number of the pixel having the state of luminance saturation which second number is not larger than a second threshold number that is not larger than the first threshold number. The above arrangement thus makes it possible to prevent luminance saturation of the converted image.

The display device of the present invention may desirably be arranged such that the display device is a liquid crystal display device.

The above arrangement makes it possible to provide a liquid crystal display device that achieves the above advantages.

INDUSTRIAL APPLICABILITY

The present invention is suitably applicable to various display devices such as a television receiver, a personal computer, a mobile telephone, and a game device.

REFERENCE SIGNS LIST

1 luminance compression section (luminance compression means)
2 luminance compression LUT
3 determining section
4 luminance expansion rate S calculating section
5 S value LUT
6 luminance expansion section (luminance expansion means)
7 W calculating section (additional color calculating means)
8 inverse γ correction section
9 counter (luminance control means, luminance fixing means)
10 luminance oscillation detecting section (luminance oscillation detecting means, detecting means)
10B luminance oscillation detecting section (luminance oscillation detecting means, luminance fixing means)
12 extracting section
13 control signal generating section
14, 14B backlight control section (illumination control means)
101 liquid crystal panel (non-self-light-emitting display section)
102 backlight (illumination means)
103 source driver (display control means)
104 gate driver (display control means)
105 controller
106 liquid crystal driving power supply
110, 110B liquid crystal display device
110*a* liquid crystal panel
110*b* liquid crystal driving control circuit
C adjustment value (set value)

The invention claimed is:

1. A display device that converts (i) an input image including pixels having a first predetermined number of reference colors into (ii) a converted image including pixels having a second predetermined number of reference colors, the second predetermined number being larger than the first predetermined number, and that displays the converted image, the display device comprising a controller, wherein the controller converts a luminance of the input image into a luminance of the converted image on a basis of a set value during the conversion of the input image into the converted image;

the controller detects, while the controller is sequentially receiving input images that are substantially identical to each other, whether converted images corresponding to the respective input images have an oscillating luminance; and the controller fixes the luminance of the converted image in a case where the controller has detected that the converted images have an oscillating luminance.

2. The display device according to claim 1, further comprising:

a non-self-light-emitting display section;

backlight configured to illuminate the display section with light having a luminance based on a luminance control signal; and a display control circuit configured to display the converted image at the display section; wherein the controller (i) generates the luminance control signal, which controls the luminance of the backlight, on a basis of information which determines the luminance of the converted image and (ii) supplies the luminance control signal to the backlight, and the controller, by detecting whether the luminance of the backlight is oscillating based on the luminance control signal, detects whether the converted images have an oscillating luminance.

3. The display device according to claim 2, wherein the controller fixes the luminance of the converted image by fixing the luminance of the backlight.

4. The display device according to claim 1, wherein the controller fixes the luminance of the converted image by fixing the set value.

5. The display device according to claim 2, wherein the controller (i) obtains luminance control signals, each being the luminance control signal, corresponding to converted images for three consecutive frames and (ii) in a case where there has been a sequential change of an increase and a decrease in the luminance of the backlight over the three frames or a sequential change of a decrease and an increase in the luminance of the backlight over the three frames, determines that the luminance controller has detected that the luminance of the backlight is oscillating.

6. The display device according to claim 1, wherein the controller (i) obtains set values, each being the set value, corresponding to converted images for three consecutive frames and (ii) in a case where there has been a sequential change of an increase and a decrease in the set values for the three respective frames or a sequential change of a decrease and an increase in the set values for the three respective frames, determines that the controller has detected that the converted images have an oscillating luminance.

7. The display device according to claim 1, wherein the controller detects whether the controller is sequentially receiving input images that are substantially identical to each other, and in a case where, after the controller has fixed the luminance of the converted image, the controller has detected that the controller is sequentially receiving input images that are not substantially identical to each other, the controller cancels the fixing.

8. The display device according to claim 1, wherein:

a predetermined time period after the controller has fixed the luminance of the converted image, the controller cancels the fixing.

9. The display device according to claim 1, wherein the controller (i) decreases the set value for use in a subsequent conversion in a case where the converted image, which has a luminance as converted by the controller, includes a first number of a pixel having a state of luminance saturation which first number is larger than a first threshold number and (ii) increases the set value for use in the subsequent conversion in a case where the converted image includes a second number of the pixel having the state of luminance saturation which second number is not larger than a second threshold number that is not larger than the first threshold number.

10. The display device according to claim 1, wherein:

the display device is a liquid crystal display device.

11. A method for controlling a display device that (i) converts an input image including pixels having a first predetermined number of reference colors into a converted image including pixels having a second predetermined number of reference colors, the second predetermined number being larger than the first predetermined number, and that (ii) displays the converted image, the method comprising the steps of:

(a) converting a luminance of the input image into a luminance of the converted image on a basis of a set value during the conversion of the input image into the converted image;

(b) detecting, while sequentially receiving input images that are substantially identical to each other during the step (a), whether converted images corresponding to the respective input images have an oscillating luminance; and (c) fixing the luminance of the converted image in a case where the step (b) has detected that the converted images have an oscillating luminance.

* * * * *